US008070388B2

(12) United States Patent
Thomas

(10) Patent No.: US 8,070,388 B2
(45) Date of Patent: Dec. 6, 2011

(54) STRUCTURE FOR TRANSPORTING, COMMISSIONING AND DECOMMISSIONING THE ELEMENTS OF A FIXED OIL PLATFORM AND METHODS FOR IMPLEMENTING SUCH A STRUCTURE

(75) Inventor: Pierre-Armand Thomas, Puteaux (FR)

(73) Assignee: Technip France (FR)

( * ) Notice: Subject to any disclaimer, the term of this patent is extended or adjusted under 35 U.S.C. 154(b) by 505 days.

(21) Appl. No.: 10/587,589

(22) PCT Filed: Dec. 30, 2004

(86) PCT No.: PCT/FR2004/003418

§ 371 (c)(1),
(2), (4) Date: Dec. 7, 2006

(87) PCT Pub. No.: WO2005/083183

PCT Pub. Date: Sep. 9, 2005

(65) Prior Publication Data

US 2008/0131209 A1 Jun. 5, 2008

(30) Foreign Application Priority Data

Jan. 28, 2004 (FR) ..... 04 00806

(51) Int. Cl.
*B63B 35/44* (2006.01)
*E02B 17/08* (2006.01)

(52) U.S. Cl. ..... 405/203; 405/196

(58) Field of Classification Search ..... 405/196–199, 405/201, 203, 204, 209
See application file for complete search history.

(56) References Cited

U.S. PATENT DOCUMENTS

| | | | | |
|---|---|---|---|---|
| 2,308,743 | A | 1/1943 | Buckley et al. | |
| 3,593,529 | A | 7/1971 | Smulders | 61/46.5 |
| 4,456,404 | A * | 6/1984 | Evans | 405/196 |
| 5,224,798 | A * | 7/1993 | Thomas | 405/198 |

FOREIGN PATENT DOCUMENTS

| | | |
|---|---|---|
| EP | 0 333 287 A2 | 9/1989 |
| WO | WO 03/080425 A1 | 10/2003 |

OTHER PUBLICATIONS

International Search Report PCT/FR2004/003418 dated May 12, 2005 (European Patent Office).

* cited by examiner

*Primary Examiner* — Sunil Singh
(74) *Attorney, Agent, or Firm* — Ostrolenk Faber LLP

(57) ABSTRACT

The invention relates to a structure for transporting, installing and dismantling a fixed oil platform provided with framework elements which are substantially formed by a bridge and at least one supporting pillar. The inventive structure comprises a floating U-shaped shell provided with at least three lifting legs adapted for resting upon the bottom of the sea and a shuttle movable along the lifting legs for displacing a platform element. Said shuttle consists of at least three elements each of which is associated with the lifting leg and is provided with mechanical means for driving on the corresponding lifting leg in a manner independent of the shell of the structure and with means for connecting to displaceable framework element. Methods for transporting, installing and dismantling the bridge or the supporting pillar of a fixed offshore oil platform are also disclosed.

16 Claims, 26 Drawing Sheets

FIG.1 - PRIOR ART -

Figure 1:
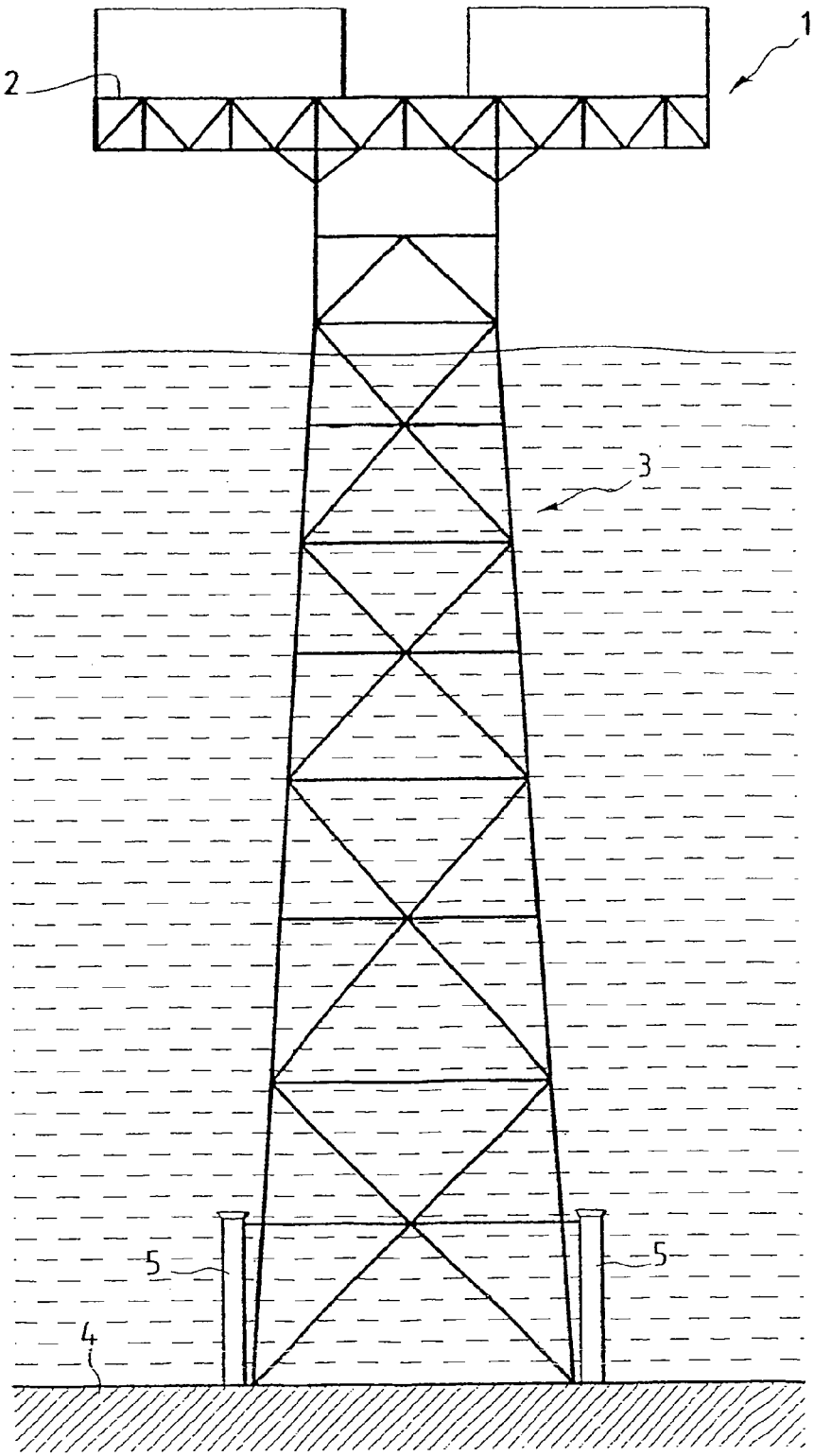

STRUCTURE FOR TRANSPORTING, COMMISSIONING AND DECOMMISSIONING THE ELEMENTS OF A FIXED OIL PLATFORM AND METHODS FOR IMPLEMENTING SUCH A STRUCTURE

CROSS REFERENCE TO RELATED APPLICATIONS

The present patent application is a §371 national stage application of PCT/FR04/03418 filed Dec. 30, 2004 which claims priority from French Application 0400806 filed on Jan. 28, 2004.

FIELD OF THE INVENTION

The present invention relates to a structure for transporting, commissioning and decommissioning an offshore fixed oil production platform comprising framework elements substantially formed by a deck and at least one supporting column.

It further relates to methods for transporting, commissioning and decommissioning the framework elements of a fixed oil platform.

DESCRIPTION OF THE RELATED ART

It is a known method in oil production to place above an oil field, a fixed oil platform comprising a deck chiefly carrying the production equipment and the living quarters. The deck is supported by a supporting column anchored to the seabed.

To date, there are two main methods for transporting, commissioning and decommissioning the framework elements of a fixed oil platform.

The first method consists of using barge-mounted lifting cranes for setting down the supporting column on the seabed and for transferring the platform deck from the transport vessel onto this supporting column. This method, which is the most widespread to date, has limitations.

The first of these limitations is actually the capacity of the lifting cranes, which may require the deck to be made in several parts, thus significantly increasing the cost of producing this deck and the cost of commissioning and decommissioning the oil platform deck.

The second limitation lies in the fact that this method demands a relatively long favorable time window to be able to carry out the various transfer operations at sea under satisfactory conditions.

Thus, without a considerable increase in cost, this method is difficult to apply in areas where time windows are relatively short, for example in the North Sea.

The second method consists of installing the supporting column on the seabed by lifting cranes and installing the oil platform deck in a single unit on the supporting column by causing it to float above it. The deck is then placed on this supporting column either by a ballasting/deballasting system, or by a mechanical system.

In the case of a ballasting system, the platform deck is supported either by a floating support consisting, for example, of a barge, pontoons or a U-shaped floating support, or through the intermediary of a structure associated with this floating support.

In the case in which the superstructure can be ballasted or deballasted, a known approach used for decommissioning the oil platform deck is deballasting the floating support and ballasting the superstructure. Since the superstructure has a large ballasting capacity, the decommissioning operation can take place relatively quickly. In the case of a superstructure anchored to the seabed, only the deballasting capacity of the floating support can be used. As this capacity is limited, the operation proceeds slowly.

Systems using ballasting or deballasting have drawbacks that lie mainly in the fact that they require a complex structure of caissons or pumps and very precise control of filling and emptying the caissons to maintain the stability of the floating support during the operation.

The speed of the operation depends on the ballasting and unballasting capacity of these floating support caissons, which is generally relatively low, thus limiting the operation's speed, especially when the superstructure is anchored on the seabed. In addition, during this operation, the sea conditions must be favorable in order to carry out this operation under satisfactory conditions.

An alternative to the ballasting/deballasting system is to use a mechanical system for raising or lowering the oil platform deck. These systems enable the operation of commissioning or decommissioning an oil platform deck to be carried out faster than the previously mentioned systems.

For this purpose, a system is known that includes two barges supporting the oil platform deck using two swiveling structures. In addition, a system of winches and cables is used to ensure the stability of the system and control the descent and ascent of the oil platform deck.

Operating these winches controls the barges' clearance, thus enabling the ascent or descent of the deck. But this kind of mechanical system offers very precarious stability and it is very often incompatible with use on the open sea.

Another mechanical system consists of a rack and pinion system for raising or lowering the oil platform deck.

In general, the mechanical systems used to date for commissioning and decommissioning an oil platform deck are faster than ballasting or deballasting systems, but they are dependent on sea conditions, which makes them difficult to use in areas where favorable time windows are relatively short.

A structure is also disclosed in application WO 03/080425 for transporting, commissioning and decommissioning a fixed oil platform deck comprising a U-shaped floating hull and a deck support shuttle that can be displaced along the legs by the hull.

BREIF SUMMARY OF THE INVENTION

The object of the invention is to provide a structure for transporting, commissioning or decommissioning an offshore fixed oil production platform that is designed to simplify and reduce the time for decommissioning said platform, whilst achieving significant time saving and avoiding any environmental pollution risks and increasing the safety of personnel responsible for carrying out the various operations.

For this purpose, the object of the invention is a structure for the decommissioning and transport of an offshore fixed oil production platform comprising framework elements substantially formed by a deck and at least one supporting column, said structure comprising:

- a U-shaped floating hull fitted with at least three lifting legs for this hull, adapted to rest on the seabed, each lifting leg being associated with mechanical displacement means housed in a bearing framework of said hull, and
- a shuttle which can be displaced along the lifting legs and intended to displace one of the platform framework elements, characterized in that the shuttle is formed of at least three elements each associated with a lifting leg and each comprising, on the one hand, mechanical drive means on the corresponding lifting leg independent of the structure's hull and, on the other hand, connecting means with the platform framework element to be displaced.

According to the specific modes of implementation:

- each shuttle element includes a vertical guidance branch on the corresponding hull bearing framework, whose top section comprises a horizontal branch supporting the mechanical drive means of said element on the corresponding leg,
- the mechanical drive means of each element comprise, on the one hand, two opposing plates supported by each vertical chord of the corresponding lifting leg each featuring, on each lateral face, a series of teeth and, on the other hand, at least two opposing assemblies, supported by the horizontal branch of said element and each formed of a pinion driven rotationally and cooperating with one of the series of teeth,
- the connecting means with the framework element formed by the platform deck comprise at least a horizontal plate supporting this deck and positioned on the bottom part of the vertical branch of each shuttle element,
- the connecting means with the framework element formed by a supporting column of the platform comprise, for each shuttle element, a linear, vertical traction device, formed of a chain or cable and two locking assemblies of said traction device, one of said assemblies being supported by said element and the other of these assemblies being supported by the hull for a gradual vertical displacement of the supporting column by successive locking of said locking assemblies,
- each locking assembly is formed of two opposing locks that can tilt vertically toward one another between a position releasing the traction device and a position blocking this traction device,
- the structure includes an independent branch for sealing the hull opening that is lockable on said hull.

The object of the invention is also a method of decommissioning and transporting as well as a method of transporting and commissioning a framework element of a fixed oil platform, formed of a deck.

A further object of the invention is a method of decommissioning and transporting as well as a method of transporting and commissioning a framework element of a fixed oil platform, formed of a section of supporting column.

BREIF DESCRIPTION OF THE DRAWINGS

Figure 2:
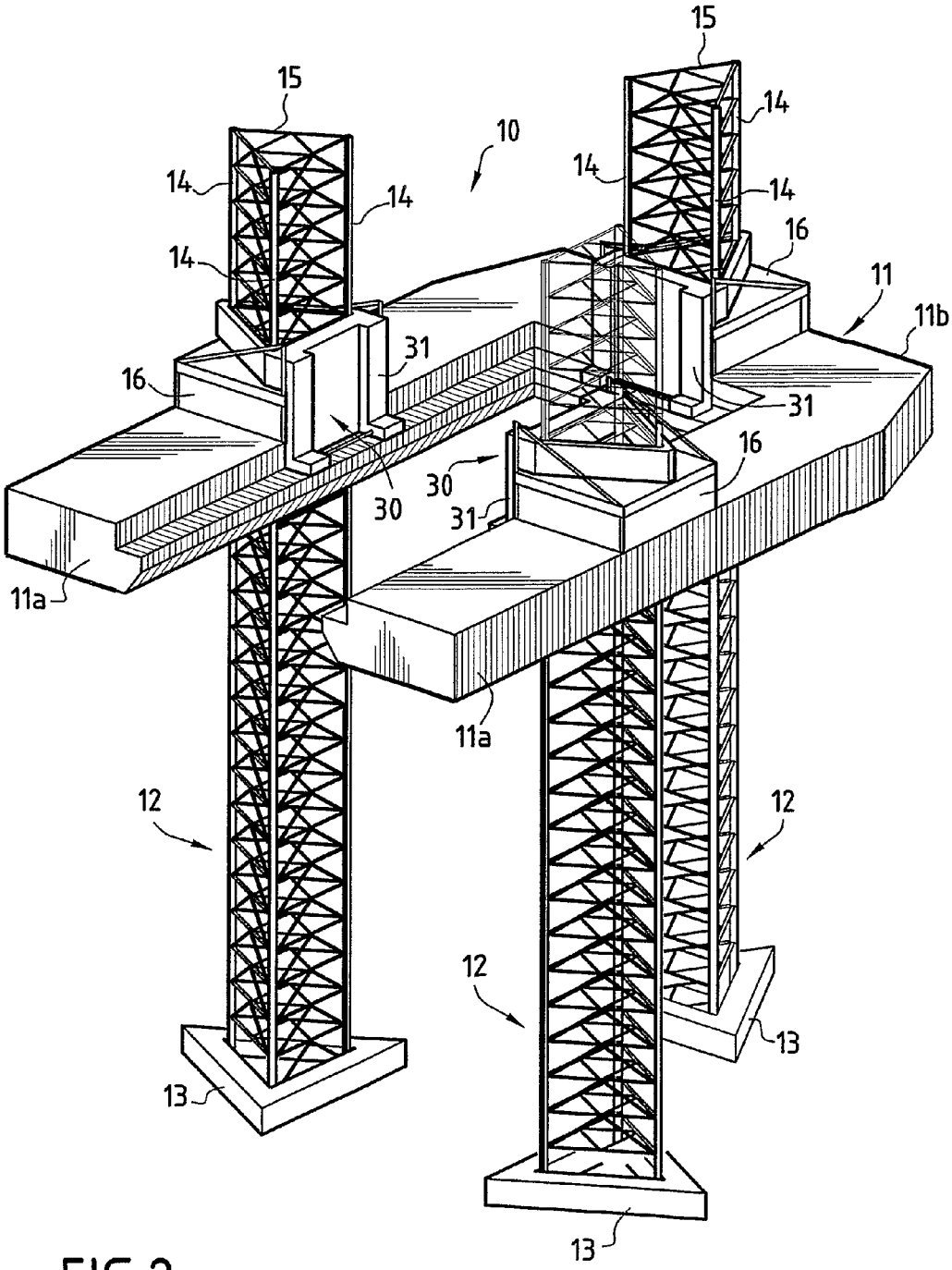
Figure 3:
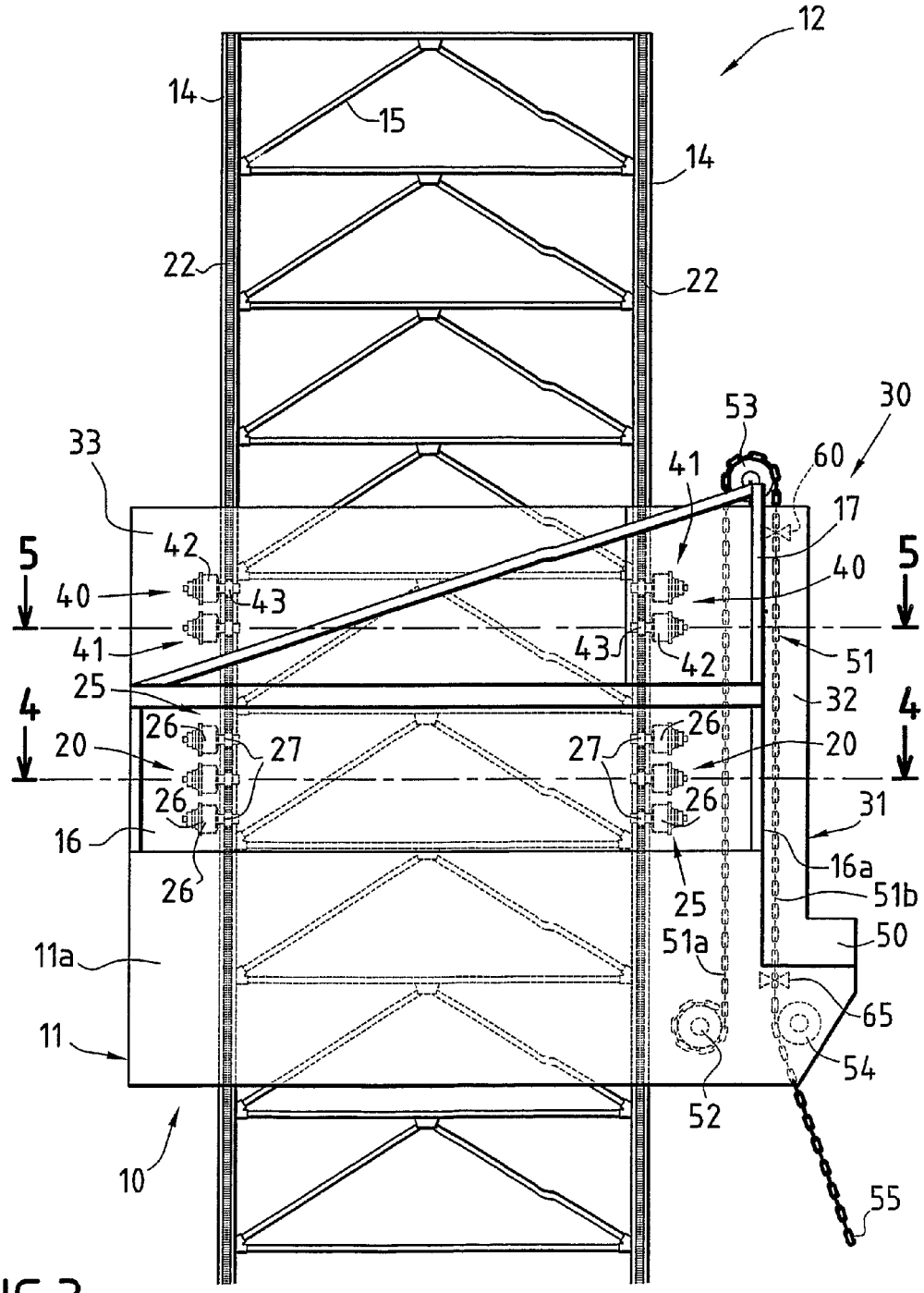
Figure 4:
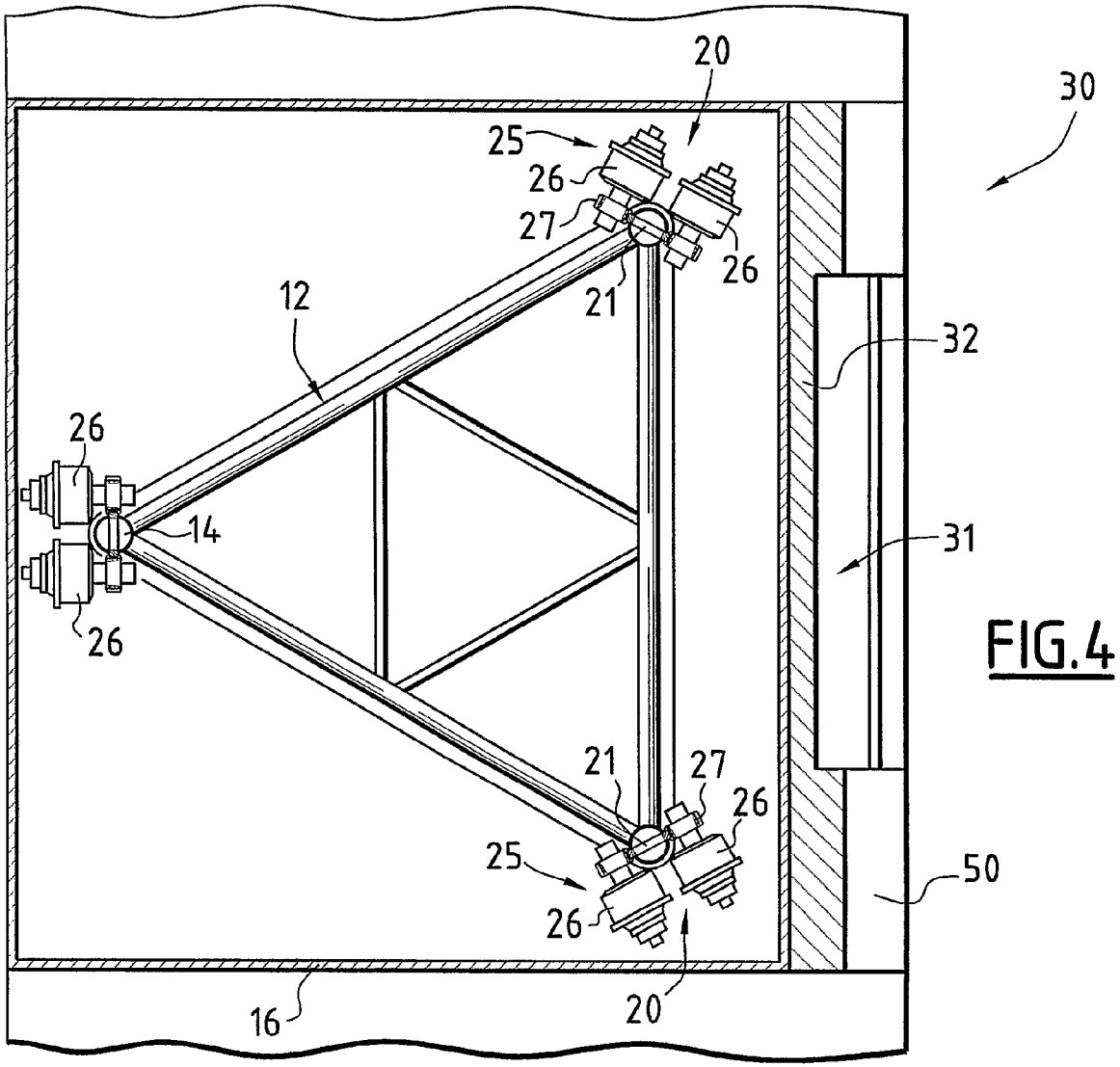
Figure 5:
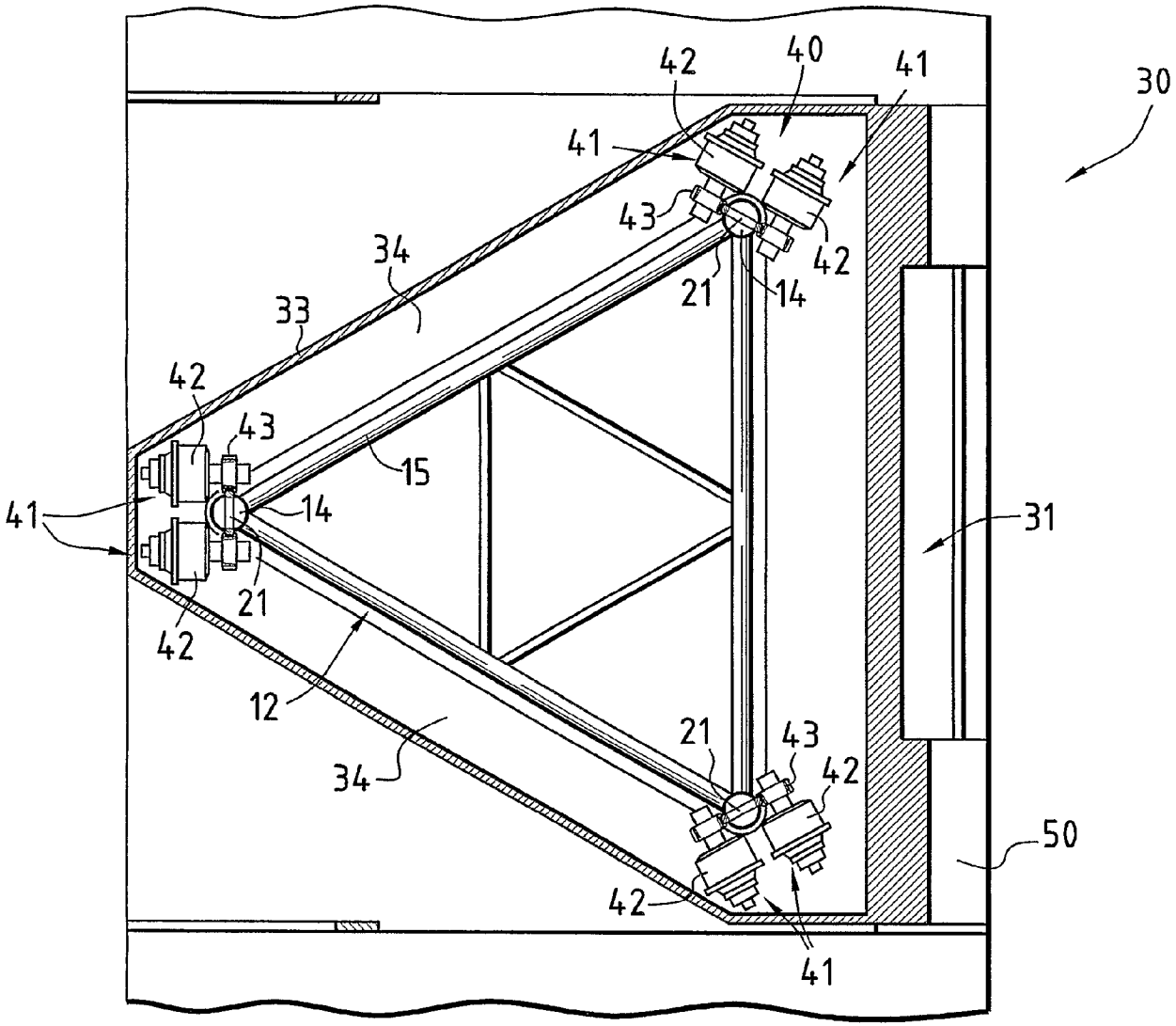
Figure 6:
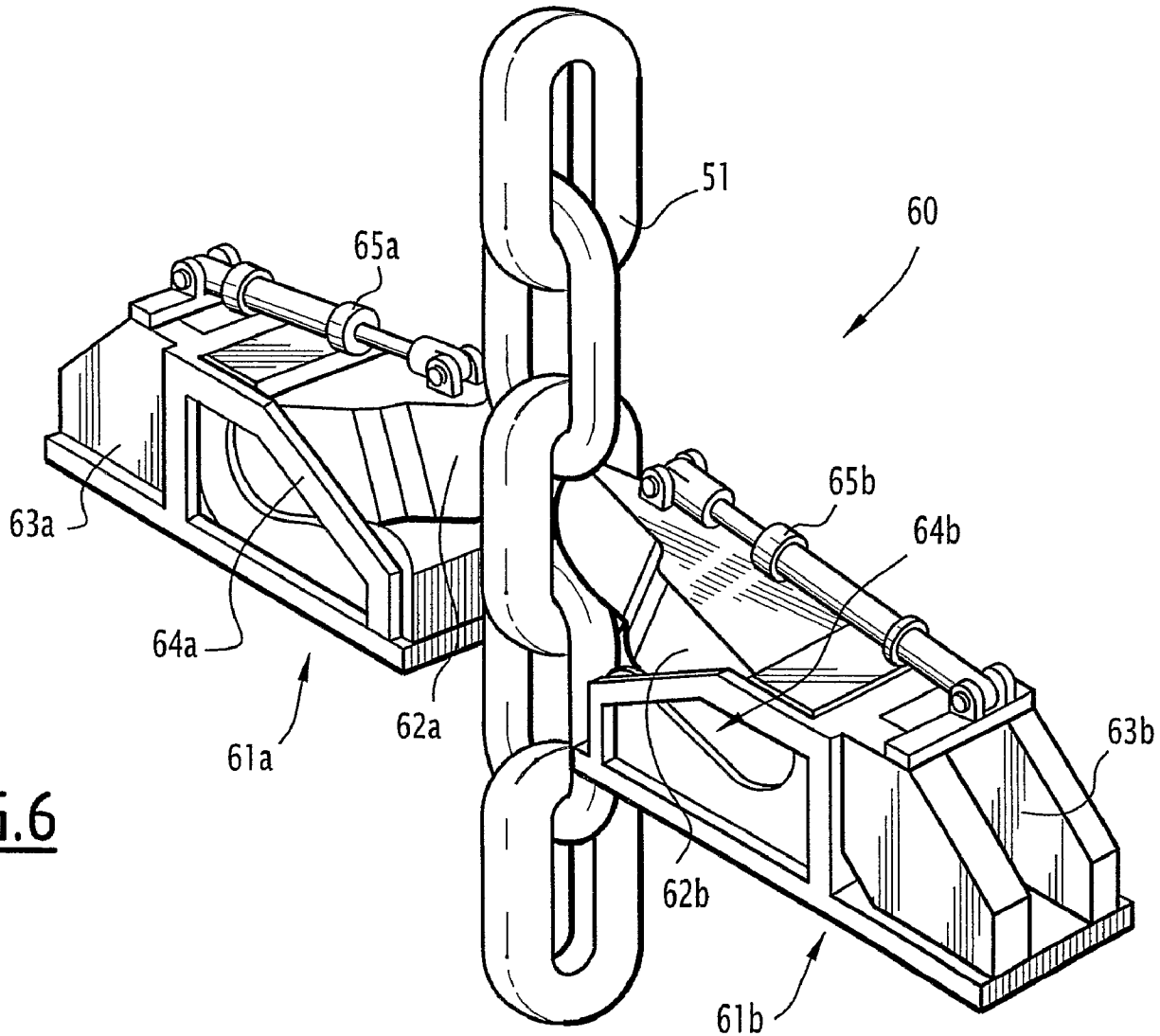
Figure 7:
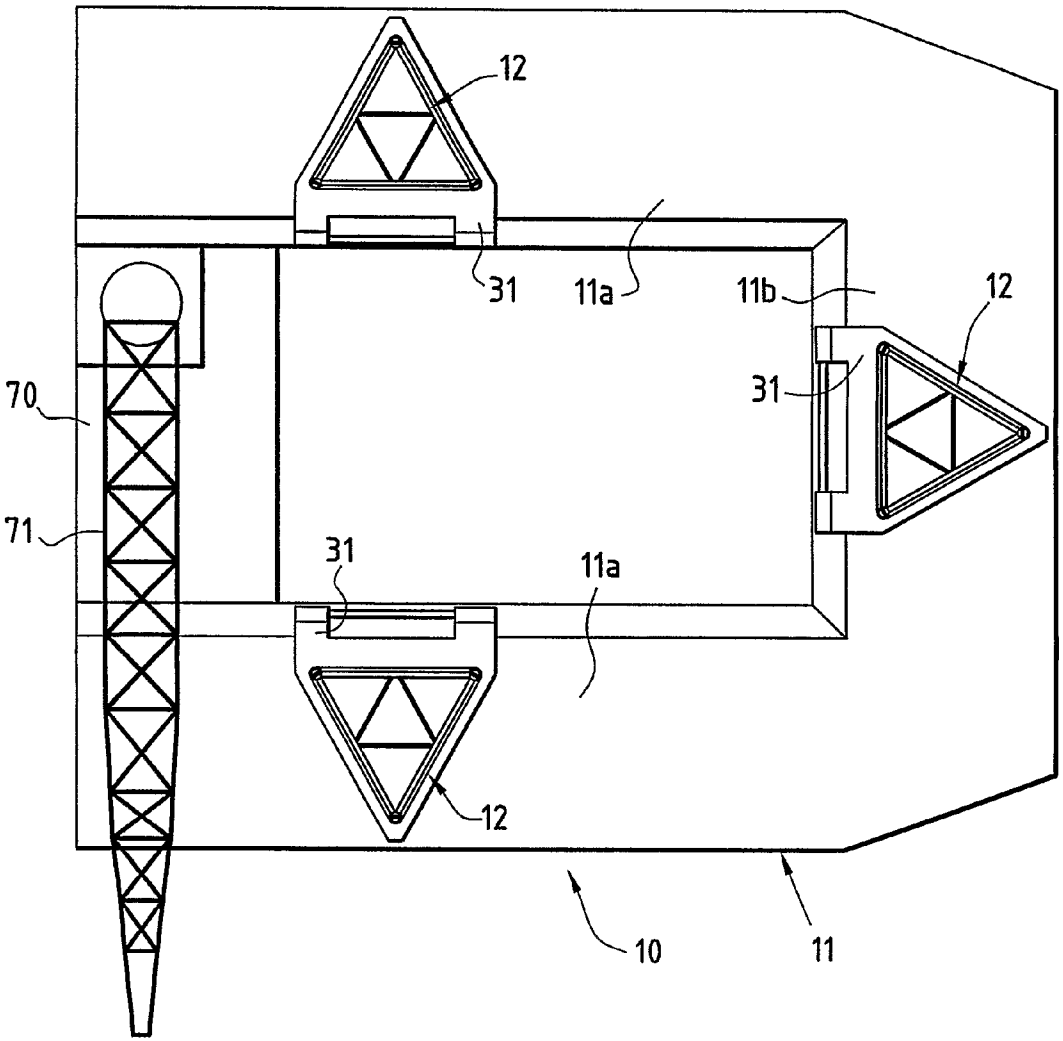

The invention will be better understood on reading the description that follows, given solely by way of example and referring to the attached drawings, in which:

FIG. 1 is a diagrammatic elevation view of a fixed oil platform in production position, FIG. 2 is a diagrammatic perspective view of a structure for transporting, commissioning and decommissioning according to the invention, FIG. 3 is a diagrammatic side view of a shuttle element of the structure according to the invention, FIG. 4 is a sectional view along the line 4-4 in FIG. 3, FIG. 5 is a sectional view along the line 5-5 in FIG. 3, FIG. 6 is a diagrammatic perspective view of a locking assembly of a linear traction device fitted on the structure according to the invention, FIG. 7 is a diagrammatic top view of the structure according to the invention, FIGS. 8A to 8H are diagrams showing the various stages of the method of decommissioning and transporting a fixed oil platform deck by means of the structure according to the invention, FIGS. 9A to 9K are diagrams showing the various stages of the method of decommissioning and transporting a fixed oil platform supporting column by means of the structure according to the invention.

DETAILED DESCRIPTION OF THE EMBODIMENTS

FIG. 1 shows a diagrammatic representation of a fixed oil platform designated as a whole by the reference 1 and including framework elements substantially formed of a deck 2 provided with the usual production equipment and living quarters and a supporting column 3 on which the deck 2 rests. The base of this column 3 is anchored to the seabed 4 by anchorage devices 5.

A structure designated by the general reference 10 and shown diagrammatically in FIG. 2 is used to ensure the transport, commissioning and decommissioning of the deck 2 and the supporting column 3 of the fixed oil platform 1 from a production site to a disassembly quay for these framework elements or vice versa.

The general dimensions of the structure as well as the proportions between the various elements making up this structure 10 have not necessarily been respected on this figure, in order to simplify understanding of the drawing.

In general, the structure 10 includes a U-shaped floating hull 11 fitted with lifting legs 12 for this hull 11 and adapted to rest on the seabed 4. The hull 11 comprises two lateral sections 11*a* and a connecting section 11*b* connecting the two lateral sections 11*a*.

In the example of embodiment shown in FIG. 2, the hull 11 is fitted with three lifting legs 12 arranged in a triangle, one leg 12 being located on each lateral section 11*a* and one leg 12 being located on the connecting section 11*b*. According to a variant, the hull 11 may be fitted with four lifting legs 12 arranged in pairs on each lateral branch 11*a* of said hull 11.

Each leg 12 terminates at its bottom end in a shoe 13 intended to rest on the seabed 4.

Each of these legs 12 in this embodiment is triangular in section, as shown in FIGS. 2, 4 and 5. These legs 12 may also be square or circular in section. Each leg 12 is formed of three chords 14 interconnected by a lattice of metal girders 15.

As shown in FIGS. 3 and 4, each leg 12 is associated with mechanical means 20 of displacing the hull 11. The mechanical means 20 for displacing each leg 12 are housed inside a bearing framework 16, also called a "jack-house" by specialists, which is supported by the hull 11.

As shown in these FIGS. 3 and 4, each chord 14 of each leg 12 comprises two opposing plates 21 each bearing, on each lateral face, a series of teeth 22 forming a double rack with the two chords 14. The mechanical displacement means 20 of the hull 11 comprise several assemblies 25 arranged on each side of each plate 21, according to its height. Each assembly 25 includes a geared motor unit 26 driving a pinion 27, which engages with a series of teeth 22 on the corresponding plate 21.

In the embodiment shown in FIGS. 3 and 4, both series of teeth 22 of each plate 21 are associated with six pinions 27, each driven rotationally by a geared motor unit 26.

The structure 10 also includes a shuttle designated by the general reference 30, which can be displaced along the legs 12 independently of the hull 11 of the structure 10 and which is intended to displace the platform 1 framework elements, i.e. either the deck 2, or the supporting column 3, as will be seen later.

As shown in FIG. 2, the shuttle 30 is made up of independent elements 31, whose number corresponds to the number of legs 12 of the structure 10. Thus, in the example of embodiment shown in the figures, the shuttle 30 consists of three independent elements 31, each associated with a lifting leg 12.

In general, each element 31 of the shuttle 30 includes mechanical drive means 40 on the corresponding lifting leg 12, independent of the hull 11 of the structure 10, together with means of connecting with the framework element 2 or 3 to be displaced on the platform 1.

Referring now to FIGS. 3 and 5, one element 31 of the shuttle 30 will be described, the other elements 31 being identical.

The element 31 includes a vertical guidance branch 32 on the bearing framework 16 of the hull 11, which then rests on a vertical wall 16*a* of this bearing framework 16. The element 31 also includes a horizontal branch 33 that has a central opening 34 for the passage of the corresponding leg 12. This horizontal branch 33 is positioned on the top part of the vertical branch 32 and supports the mechanical drive means 40 of said element 31 on the leg 12.

The mechanical drive means 40 of each element 31 on the corresponding leg 12 operate independently of the mechanical displacement means 20 of the hull 11 and these means 40 of the assembly of elements 31 operate in synchronization with one another so as to achieve the same displacement of each element 31 on the corresponding leg 12. The mechanical displacement means 40 of each element 31 of the shuttle 30 comprise several assemblies 41 arranged on each side of each plate 21 on the chord 14, according to its height. Each assembly 41 includes a geared motor unit 42 driving a pinion 43, which engages with a series of teeth 22 on the corresponding plate 21.

In the embodiment shown in FIGS. 3 and 5, both series of teeth 22 of each plate 21 are associated with four pinions 43, each driven rotationally by a geared motor unit 42.

As shown in FIG. 3, the vertical wall 16*a* of the bearing framework 16 acting as guidance for the vertical displacement of the corresponding element 31 is extended, at its top, by a vertical plate 17 on which the element 31 slides so as to increase the height of vertical displacement of this element 31.

Moreover, the connecting means of each element 31 of the shuttle 30 with the framework element 2 or 3 to be displaced are of two kinds for each of said elements 31.

Now referring to FIG. 3, a description will be given of the connecting means associated with one element 31 of the shuttle 30, the connecting means of the other elements 31 of this shuttle 30 being identical.

The first of these means intended for displacing the deck 2 of the oil platform 1 consists of a horizontal plate 50 supporting the deck 2 while it is being transported, as will be seen later.

The second of these means intended for displacing the supporting column 3 consists of a linear, vertical traction device 51, formed of a chain or cable. In the exemplary embodiment shown in the figures, the traction device 51 consists of a chain.

As shown in FIG. 3, the chain 51 may be wound on a drum 52 positioned in the hull 11 of the structure 10 and comprises a first ascending part 51*a* that traverses the bearing framework 16 of the hull 11, the horizontal branch 33 of the element 31 and emerges at the top of the vertical branch 31 of the element 30. At this point, the chain 51 passes over a return pulley 53 and comprises a descending part 51*b* that traverses the vertical branch 32 of the element 31 and runs along the hull 11 where it is guided by a pulley 54 fixed onto this hull 11.

The end of the chain 51 is fitted with a known type of system for coupling 55 onto the supporting column 3 during its displacement.

The chain 51 is associated with two locking assemblies 60 and 65, one 60 being mounted on the element 31 and the other 65 being mounted on the hull 11. These two assemblies 60 and 65 operate independently of one another thus enabling the chain 51 to be secured to the element 31 or to the hull 11.

Now referring to FIG. 6, a description will be given of an example of a locking assembly, for example the locking assembly 60, the locking assembly 65 being identical.

As shown in this figure, the locking assembly 60 is made up of two identical and symmetrical subassemblies, 61*a* and 61*b* respectively.

The first subassembly 61*a* consists of a lock 62*a* fitted on a base 63*a*, that can be tilted around a horizontal shaft 64*a* borne by the base 63*a*. The tilting of the lock 62*a* between a raised position and a lowered position is controlled by a cylinder 65*a*, for example hydraulic or pneumatic, whose one end is integral with the base 63*a* and whose other end is integral with the lock 62*a*. Likewise, the second subassembly 61*b* consists of a lock 62*b* fitted on a base 63*b*, that can be tilted around a horizontal shaft 64*b* borne by said base 63*b*. The tilting of the lock 62*b* between a lowered position and a raised position is controlled by a cylinder 65*b*, for example hydraulic or pneumatic, whose one end is integral with the base 63*b* and whose other end is integral with the lock 62*b*. The displacement of the locks 62*a* and 62*b* is simultaneous. In the lowered position, the locks 62*a* and 62*b* block the chain 51, as shown in FIG. 6.

Finally, as shown in FIG. 7, the opening of the "U" of the hull 11 of the structure 10 may be closed off by an independent branch 70, which might possibly support a crane 71 for displacing modules of the oil platform 1 or of another platform next to which the transport structure 10 may be installed. Conventionally, this branch 70 may be installed by a ballastable/deballastable barge, not shown, and may be locked, then unlocked from the hull 11 of the structure 10.

Transporting the deck 2 of the oil platform 1 by the structure 10 between a production site and a port quay is performed in the following way.

Figure 8A:
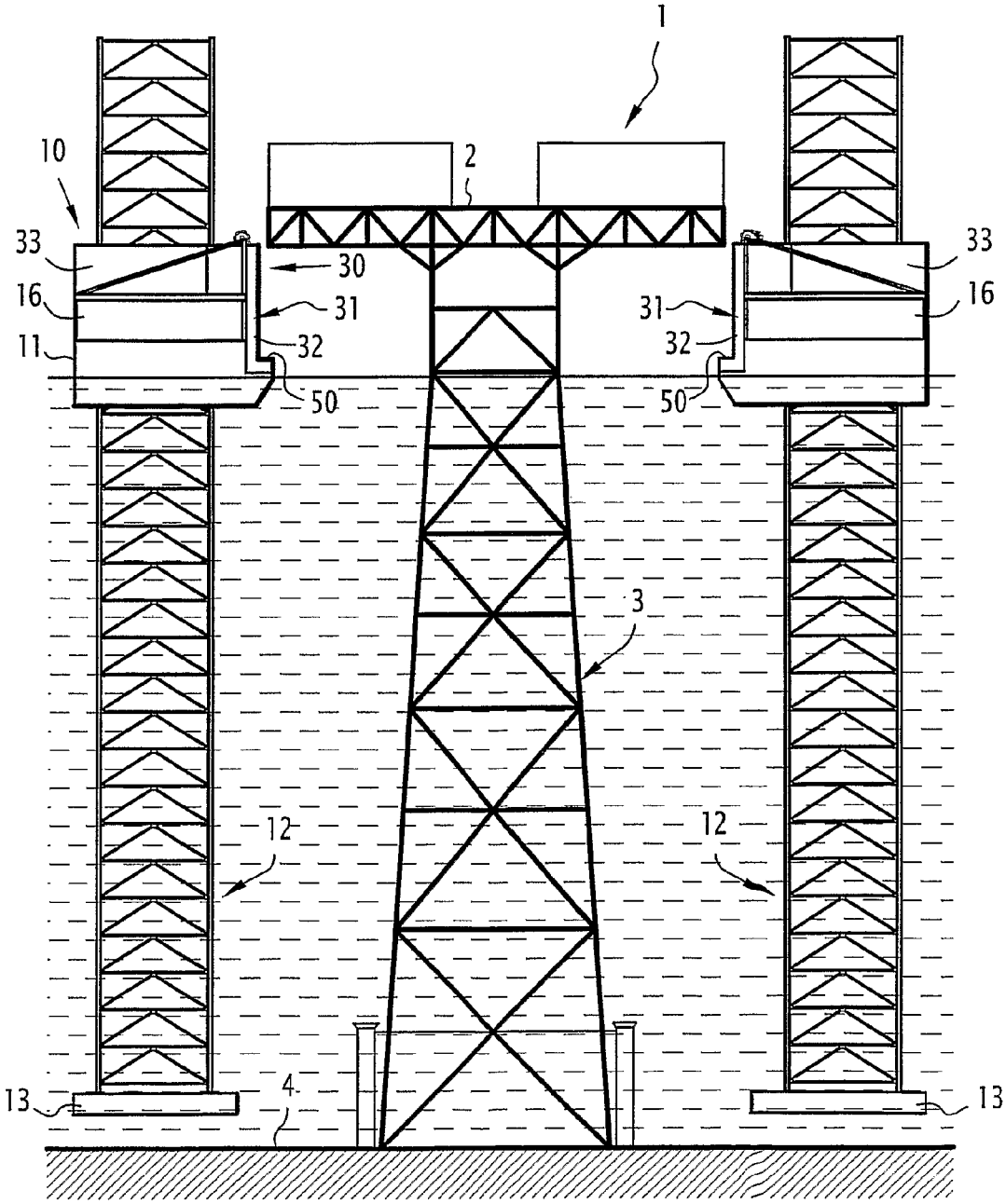

First of all, as shown in FIG. 8*a*, the structure 10 without the additional branch 70, is floated beneath the deck 2 of the platform 1 by positioning the supporting column 3 of this deck 2 in the U-shaped space created between the lateral sections 11*a* of the hull 11. During its positioning, the lifting legs 12 are in a retracted position and the shoes 13 are placed beneath the hull 11.

Figure 8B:
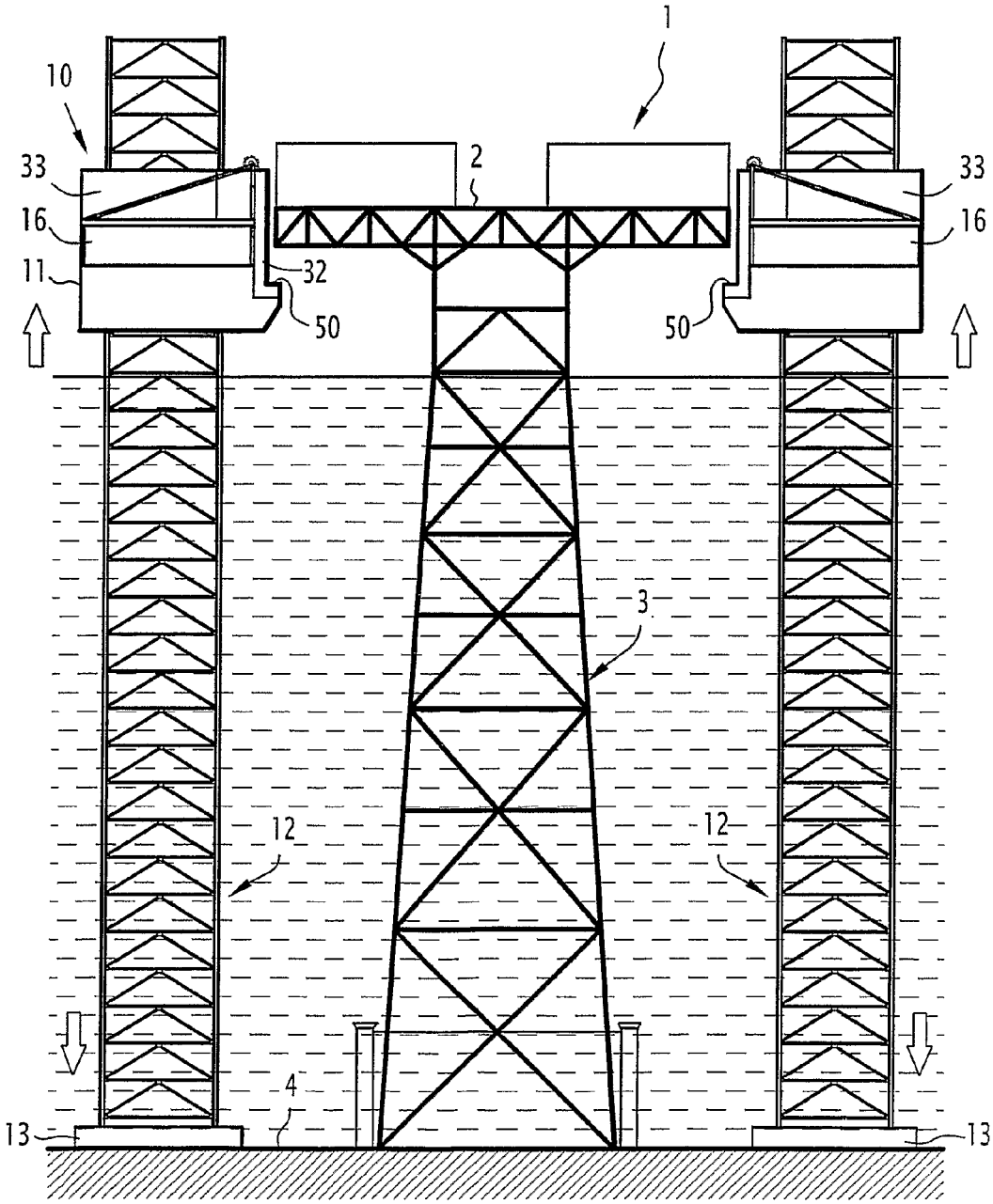

The horizontal branches 50 of the elements 31 of the shuttle 30 are in a substantially low position at the level of the hull 11, as shown in FIG. 2. Then the geared motor units 26 and 42 respectively of the hull 11 and of the elements 31 of the shuttle 30, are actuated to rotationally drive the pinions 27 and 43, which engage with the series of teeth 22 of the plates 21 of each lifting leg 12 to bring the shoes 13 into contact with the seabed 4, as shown in FIG. 8B. As soon as the shoes 13 are in contact with the seabed 4, the hull 11 and the elements 31 of the shuttle 30 move upward along the legs 12, under the effect of the rotational driving of the pinions 27 and 43, which engage with the series of teeth 22 on the plates 21 in the lifting legs 12.

Figure 8C:
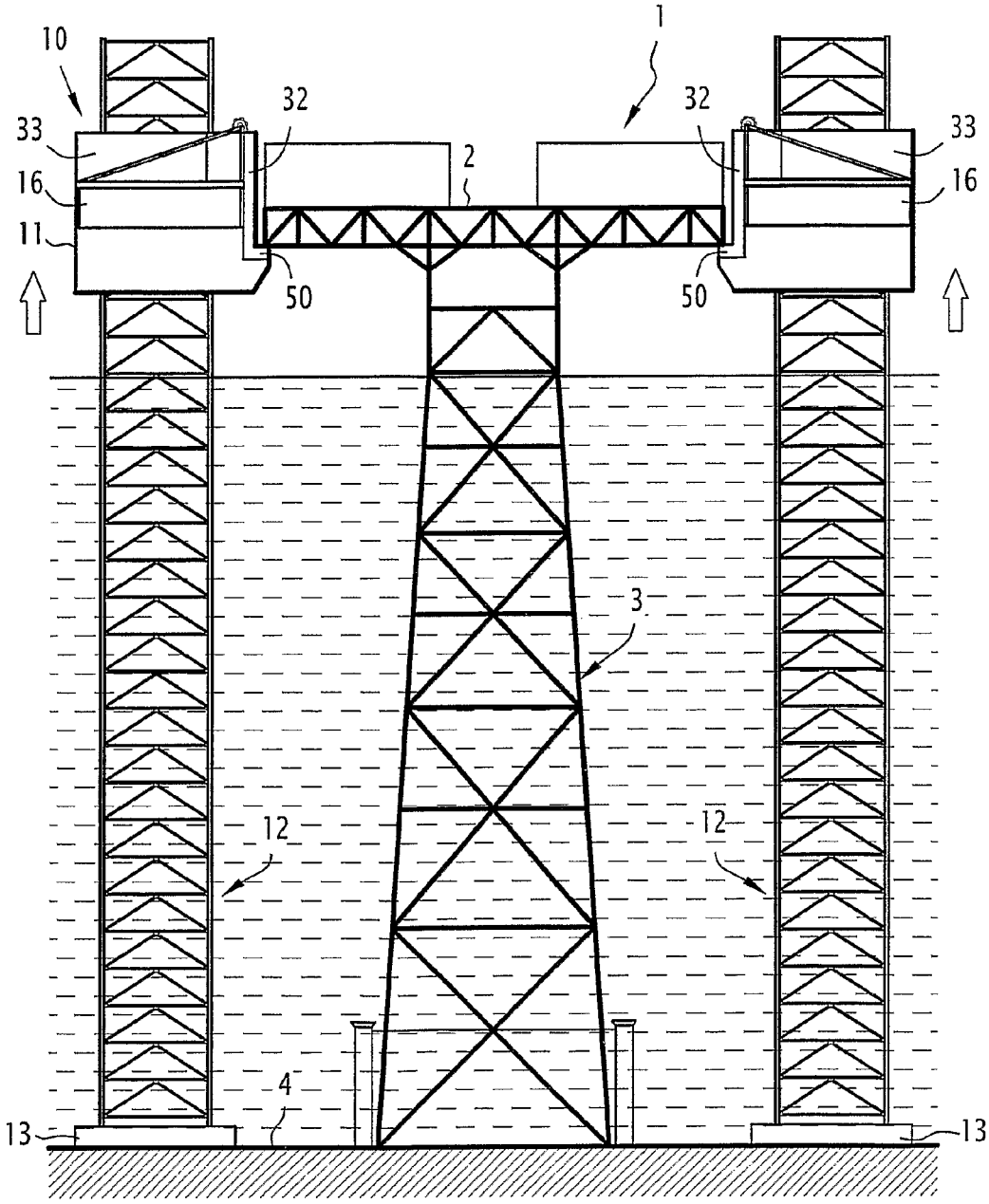

By moving upward, the elements 31 of the shuttle 30 come to be applied against the bottom face of the deck 2 and the driving of the pinions 27 and 43 is stopped (FIG. 8C).

The supporting column 3 is then separated from the deck 2 and the elements 31 of the shuttle 30 are raised in order to separate the deck 2 from the supporting column 3, which remains in a vertical position as shown in FIG. 8C.

Several variants may be envisaged.

Figure 8D:
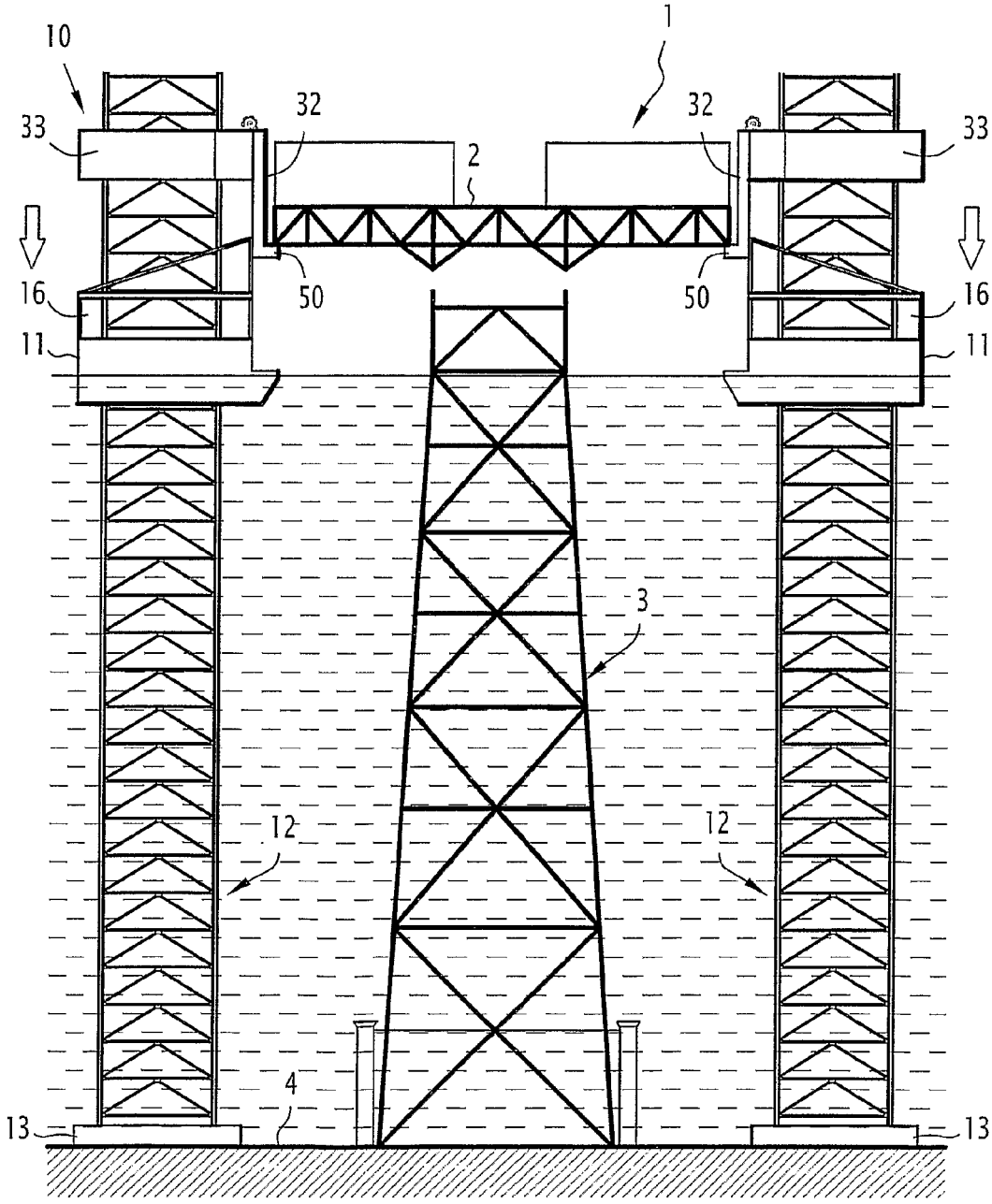
Figure 8E:
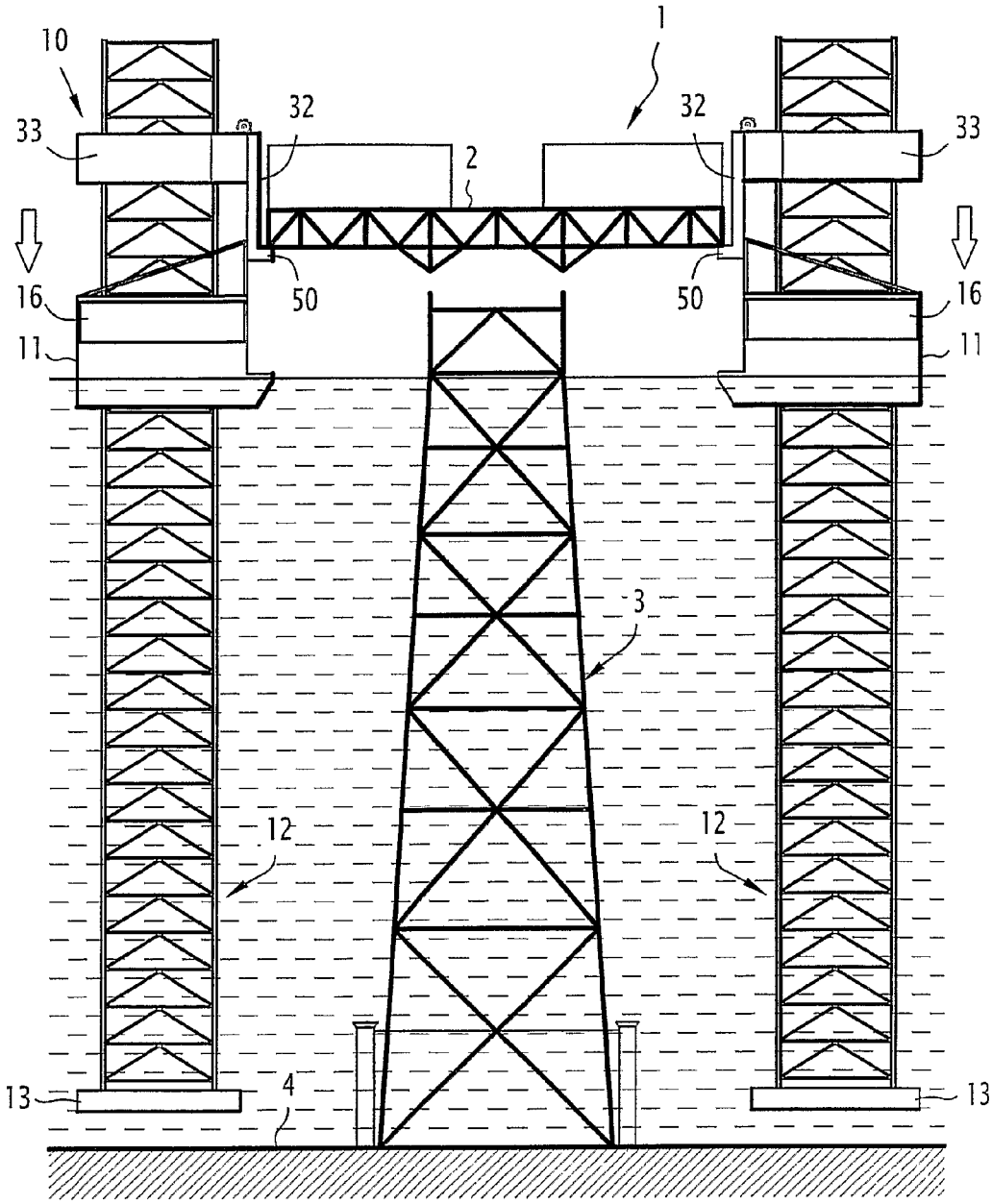

The first consists of locking the elements 31 of the shuttle 30 onto the lifting legs 12, floating the hull 11 so as to reduce the loads on these lifting legs 12 and the seabed 4, separating the supporting column 3 from the deck 2 and lifting the elements 31 of the shuttle 30 via the pinions 43, which engage with the series of teeth 22, as shown in FIG. 8E. As an alternative, the elements 31 of the shuttle 30 may not be lifted by the pinions 43, but locked onto the lifting legs 12. Raising the elements 31 and the deck 11 may then be carried out passively when these lifting legs 12 are brought back up.

The second variant consists of locking the elements 31 of the shuttle 30 onto the lifting legs 12, cutting away a section of the supporting column 3 of sufficient length, removing this section in order to separate the deck 2 from the rest of the supporting column 3 and floating the hull 11.

The third consists of separating the supporting column 3 from the deck 2, lifting the elements 31 of the shuttle 30 by means of the pinions 43, which engage with the series of teeth 22, then locking these elements 31 onto the lifting legs 12 and, finally, lowering the hull 11 into floatation (FIG. 8D).

Finally, the fourth variant consists of separating the supporting column 3 from the deck 2, lifting the elements 31 of the shuttle 30 and the hull 11, locking these elements 31 onto the lifting legs 12 and floating the hull 11.

After floating the hull 11, the pinions 27 are still rotationally driven, which causes the lifting legs 12 to ascend by reaction due to the downward thrust of the hull 11 into the water (FIG. 8E).

The hull 11 supporting the deck 2 via the intermediary of the shuttle 30 is removed from the production site where the supporting column 3 is still in place.

Figure 8F:
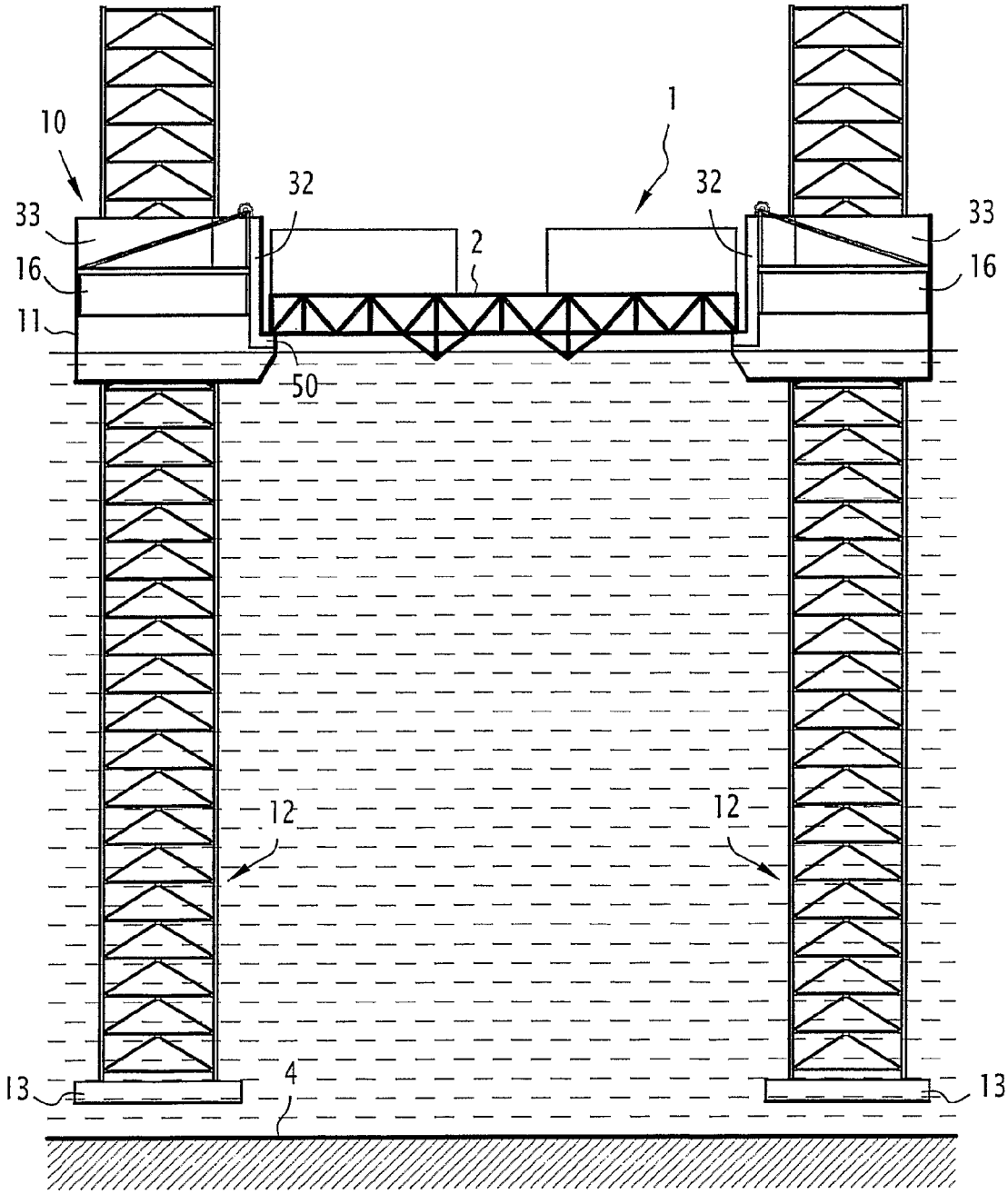
Figure 8G:
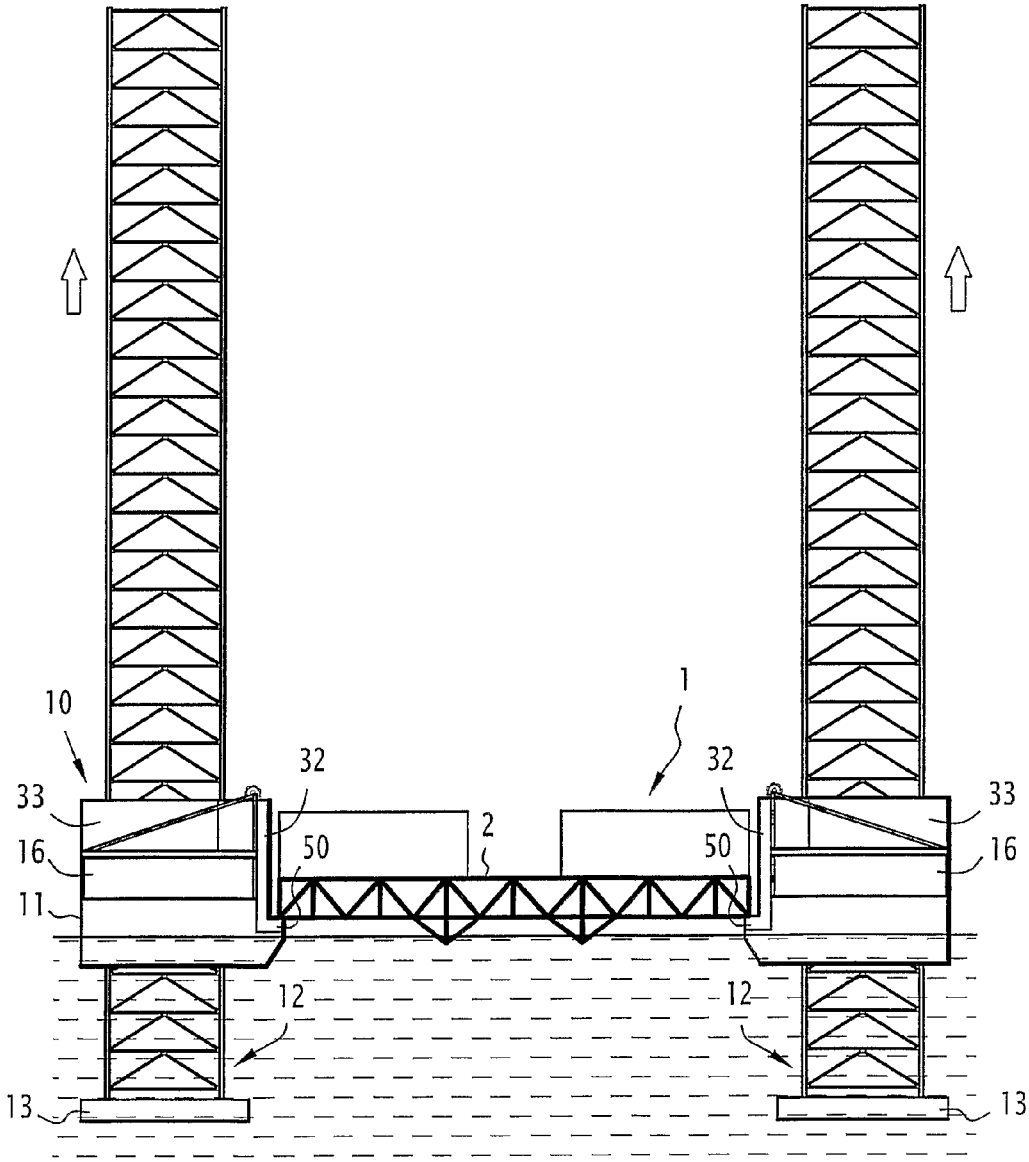

The elements 31 are then unlocked from the lifting legs 12 and are lowered by the pinions 43 being driven in the reverse direction, which engage with the series of teeth 22 to bring these elements 31 supporting the deck 2 substantially to the level of the hull 11 (FIG. 8F). The structure 10 transports the deck 2 by floatation, as shown in FIG. 8G. During this transport the lateral stabilization of the deck 2 on the elements 31 of the shuttle 30 may be ensured by cylinders, not shown, which are in contact with the lateral faces of this deck 2.

Figure 8H:
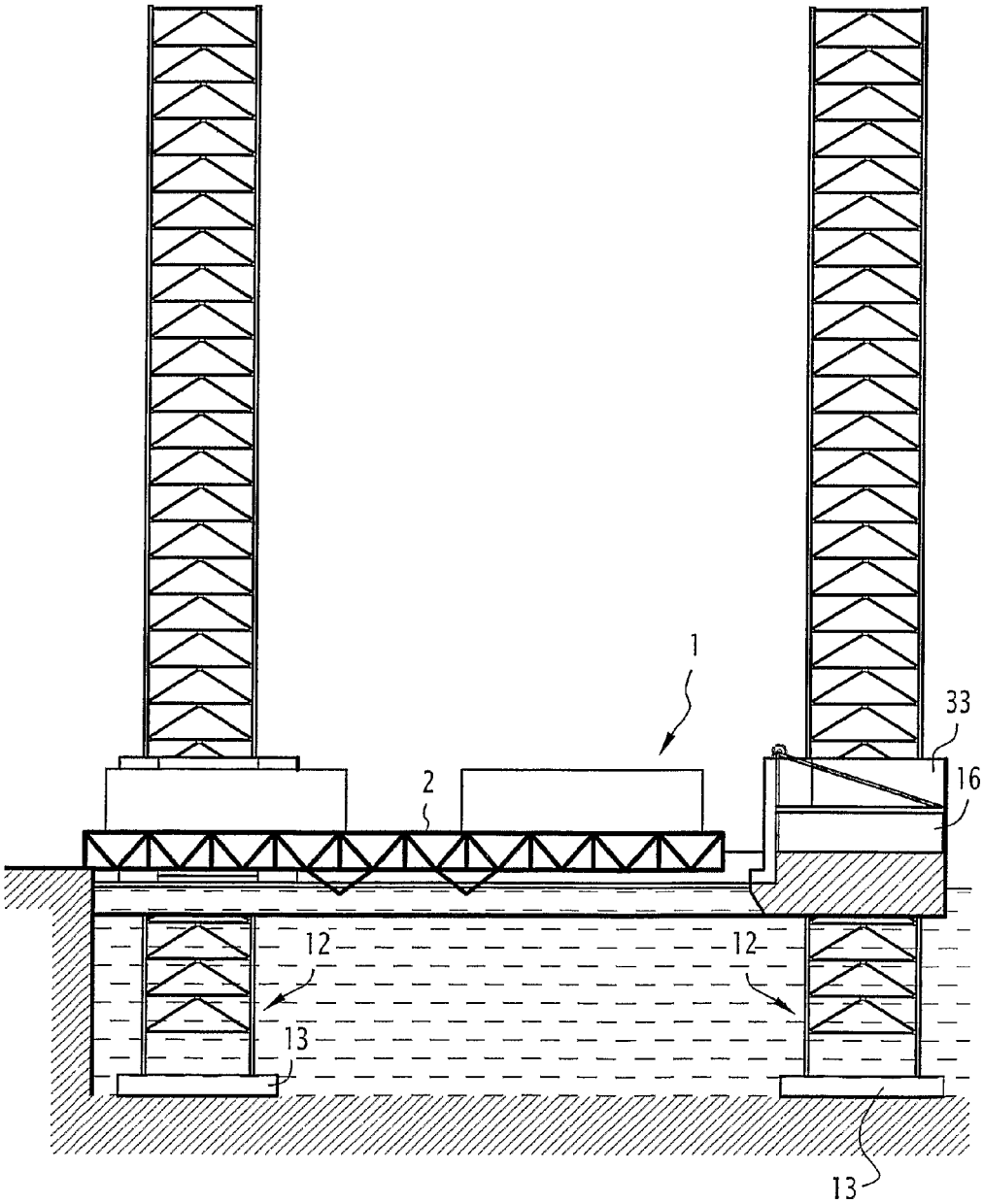

In the example of embodiment shown in FIG. 8H, the hull 11 supporting the deck 2 is floated up to a port quay and the lifting legs 12 are applied to the bottom to stabilize this hull 11.

A connecting part 6 is placed between the hull 11 and the quay to ensure continuity between the surface of this hull 11 and said quay. The deck 2 is then unloaded onto this quay.

According to a variant, the deck 2 may be unloaded beforehand onto a barge that transports this deck up to the quay.

The structure 10 according to the invention may also be used for commissioning a deck 2 on a supporting column 3 by substantially performing the same operations in the reverse direction.

The structure 10 also enables the decommissioning of a supporting column 3.

Figure 9A:
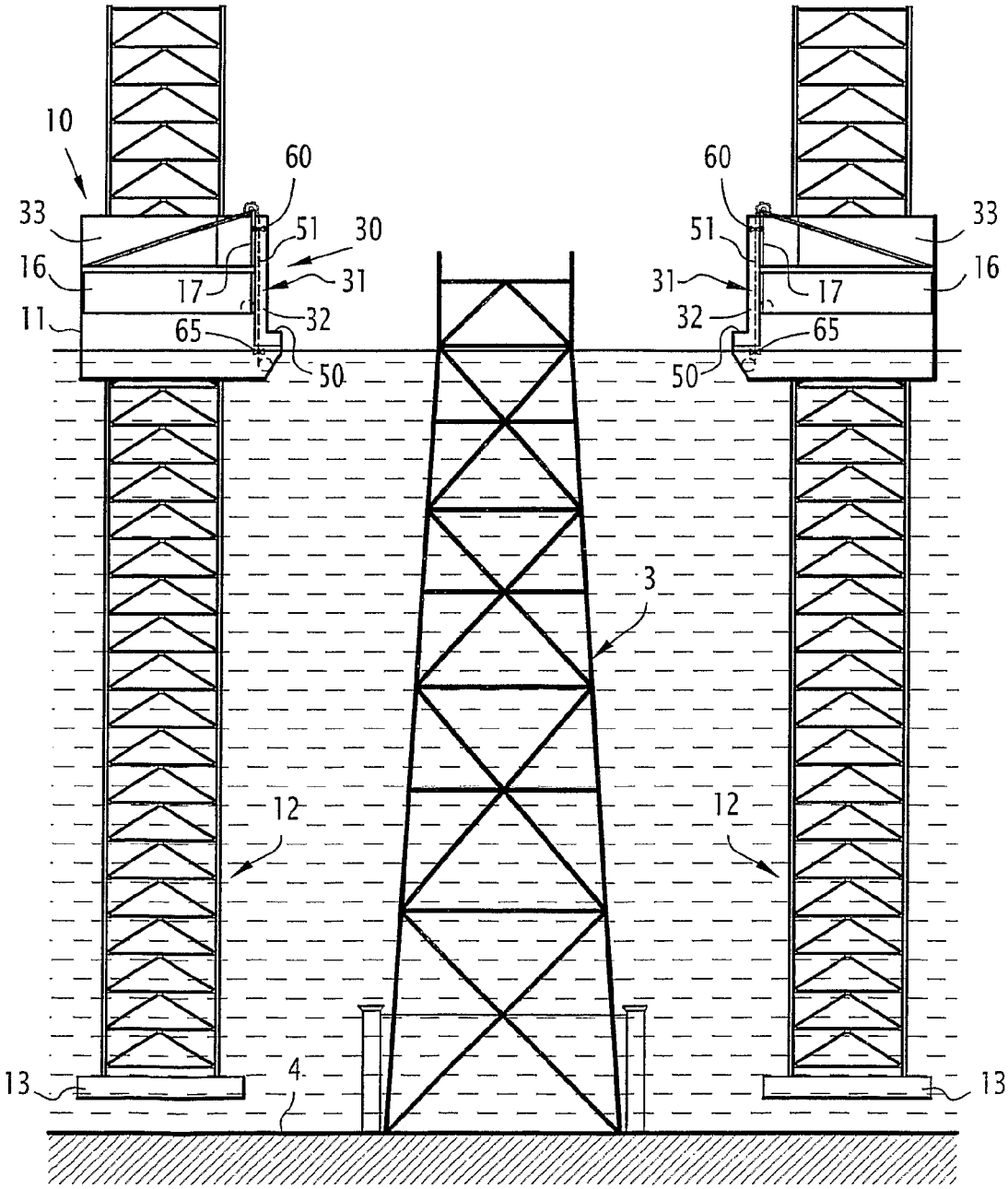
Figure 9B:
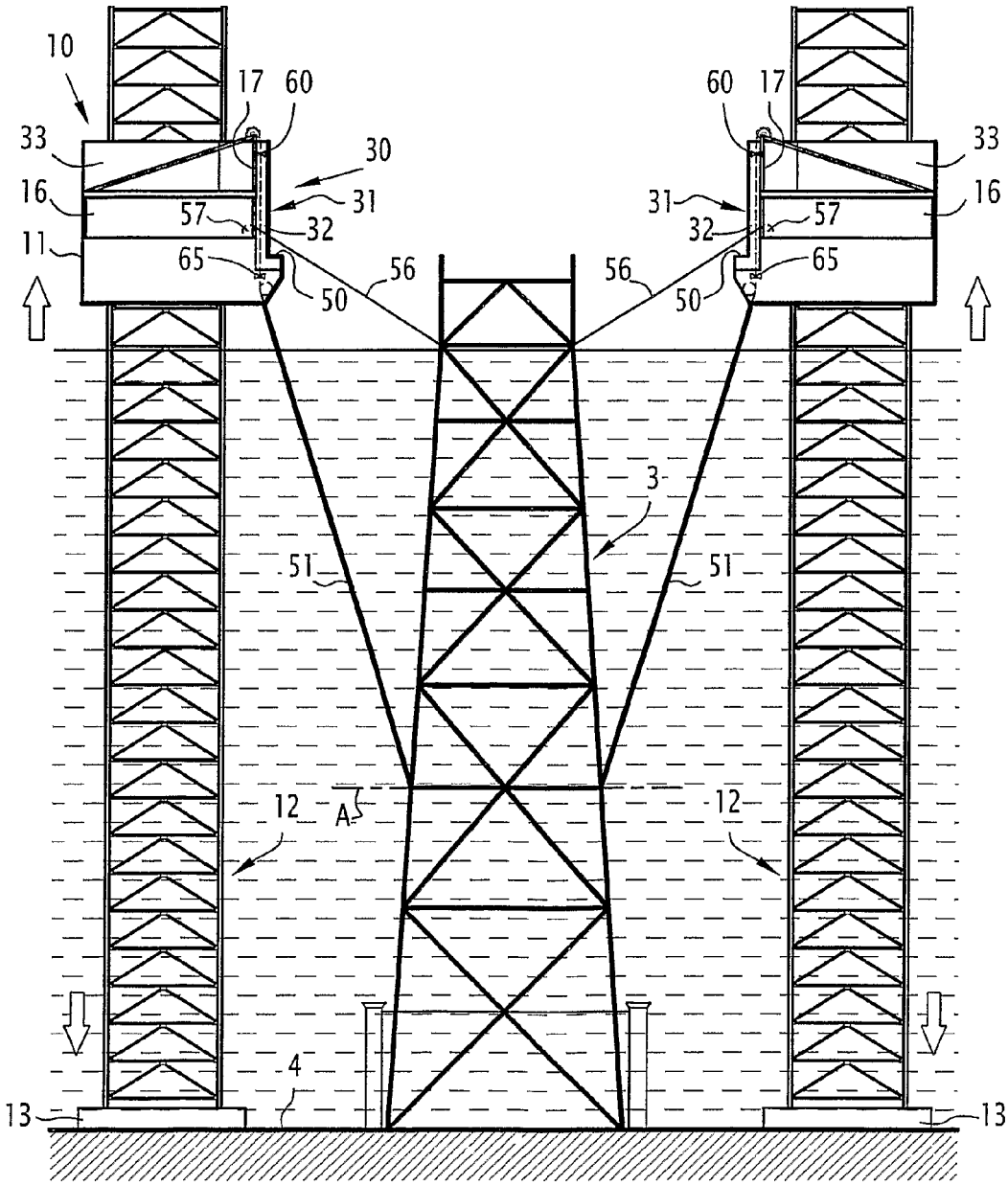

After removing the deck 2 from the supporting column 3, the structure 10 is floated around the supporting column 3, as shown in FIG. 9A.

The geared motor units 26 and 42 are then actuated to rotationally drive the pinions 27 and 43, which engage with the series of teeth 22 on the plates 21 of each lifting leg 12 in order to bring the shoes 13 into contact with the seabed 4.

As soon as the shoes 13 are in contact with the seabed 4, the hull 11 and the elements 31 of the shuttle 30 move upward along the legs 12, under the effect of the rotational driving of the pinions 27 and 43, which engage with the series of teeth 22. The hull 11 and the elements 31 of the shuttle 30 are thus positioned above the water level. The free ends of the chains 51 are connected by coupling systems 55 to the supporting column 3 and this supporting column 3 is separated at level A (FIG. 9B) from the part of it anchored to the seabed 4.

The top end of the section of supporting column 3 is coupled via cables 56 to the hull 11 and these cables 56 are wound on drums 57 so as to allow them to be extended.

After these various stages, the locking assembly 60 of each element 31 of the shuttle 30 is actuated by the locks tilting so as to secure the chains 51 and accordingly the supporting column 3 of these elements 31. The locking assemblies 65 are in an open position to allow the chains 51 to slide.

Figure 9C:
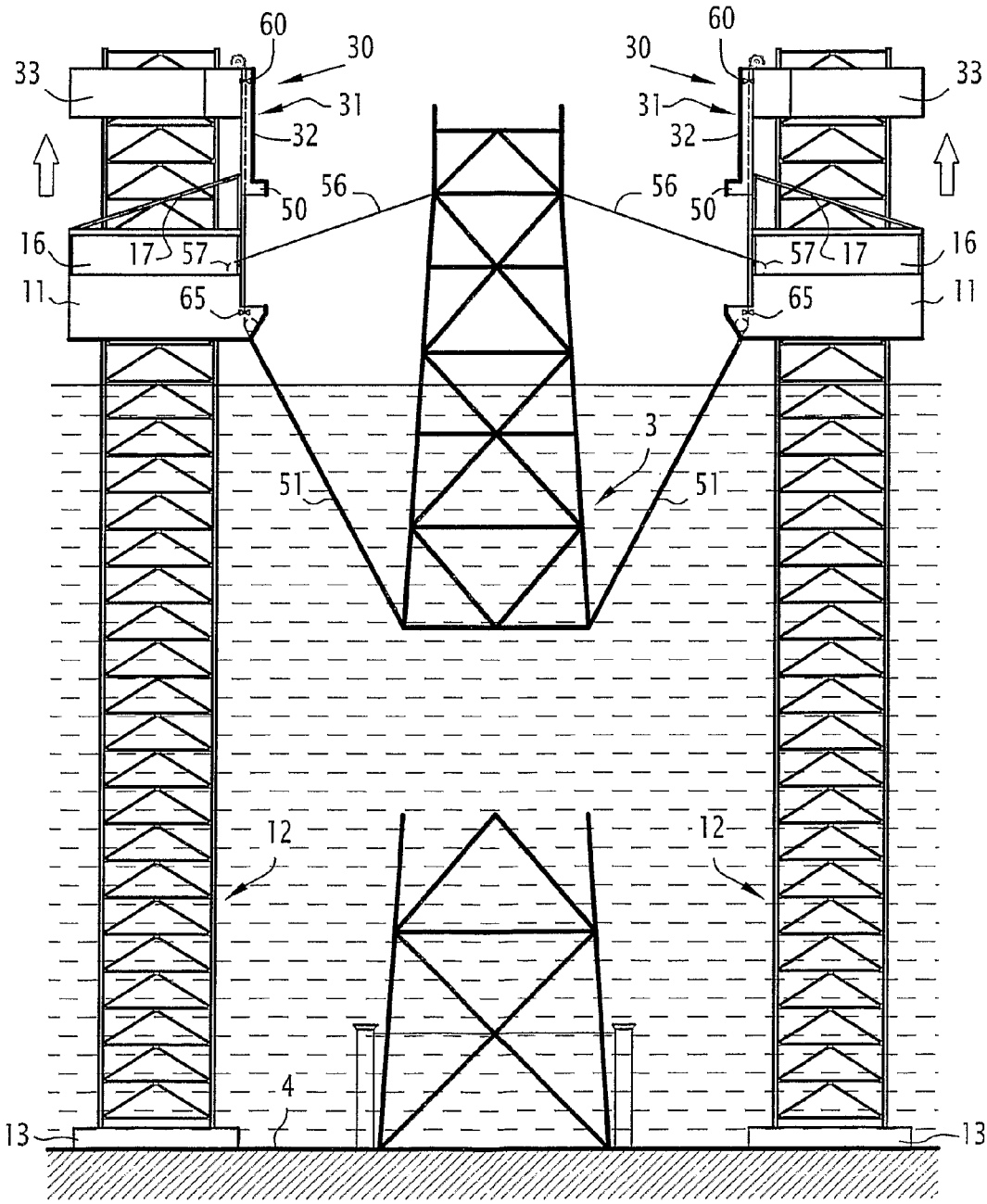
Figure 9D:
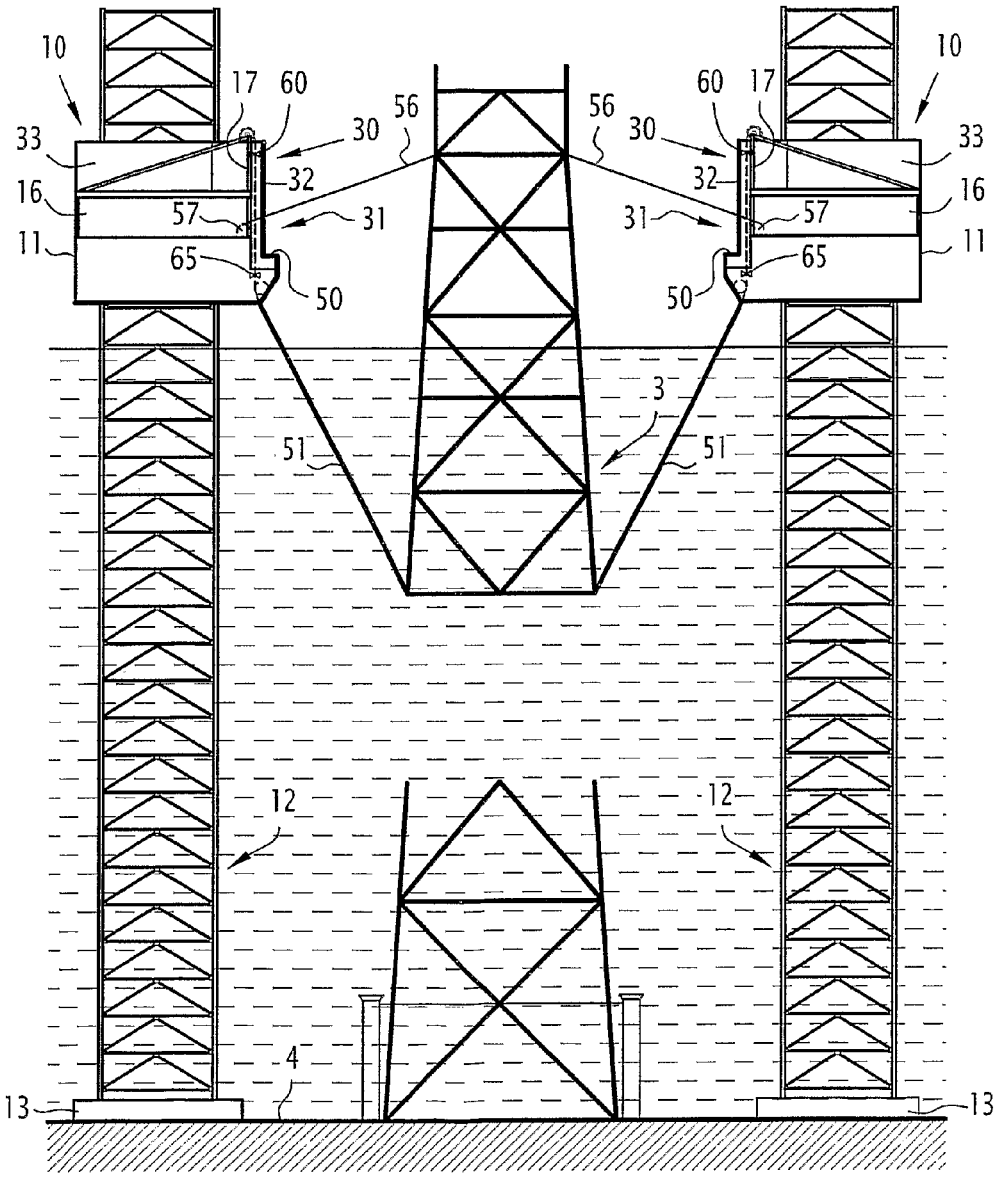

The elements 31 of the shuttle 30 are next raised by rotationally driving the pinions 43 by means of the geared motor units 42, which engage with the series of teeth 22 on the plates 21 of each lifting leg 12. Due to the chains 51 being integral with these elements 31 the section of supporting column 3 is also raised. During this displacement, the elements 31 of the shuttle 30 are first of all guided towards the vertical wall 16*a* of the bearing framework 16 of the hull 11 and by the plates 17, as shown in FIG. 9C. After this first operation of lifting the section of supporting column 3, the locking assemblies 65 are actuated to lock the chains 51 and secure these chains 51 on the hull 11. The locking assemblies 60 are opened by the locks being tilted so as to release the chains 51 of the elements 31 of the shuttle 30. These elements 31 are lowered to bring them down substantially to the level of the hull 11, as shown in FIG. 9D.

Figure 9E:
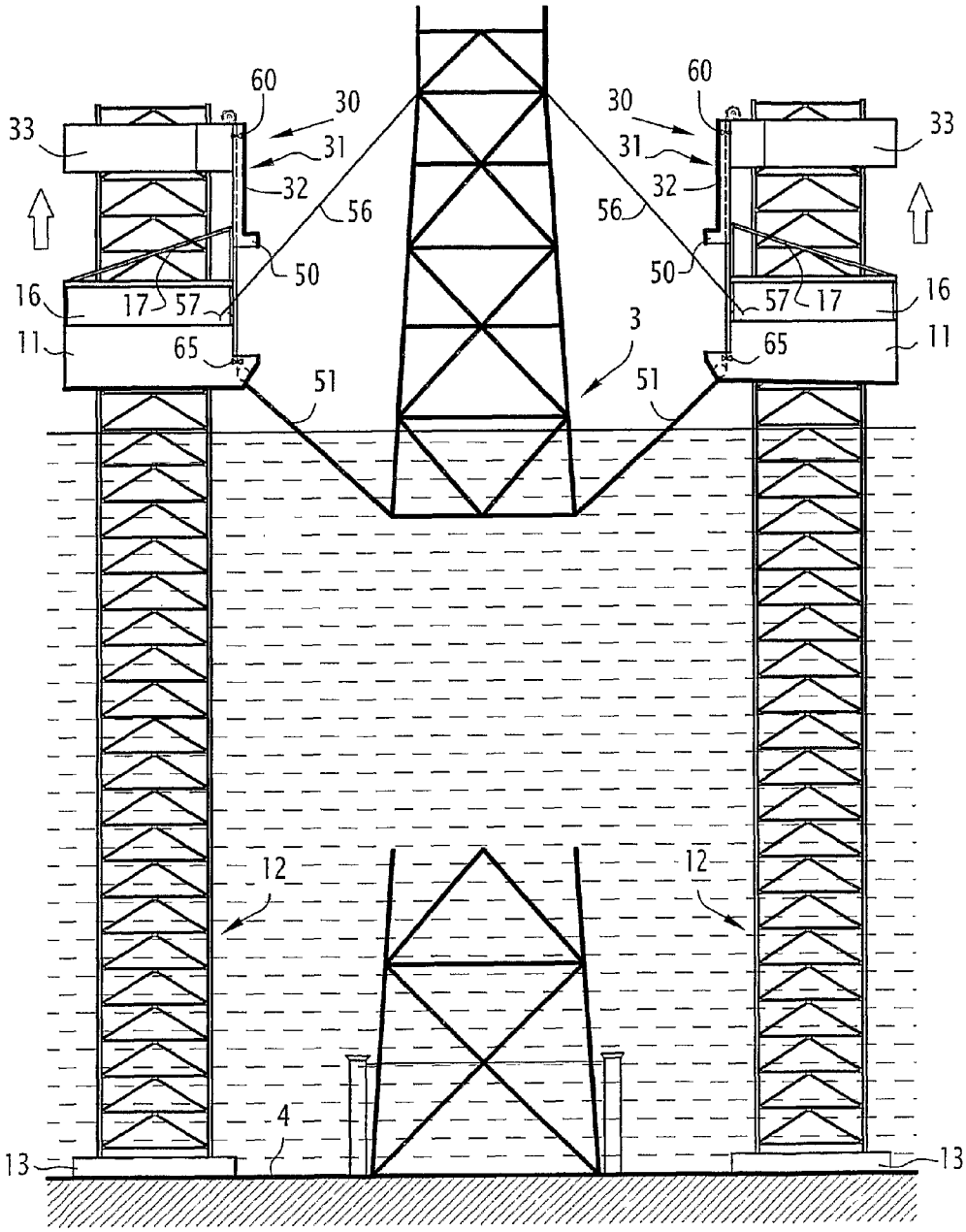
Figure 9F:
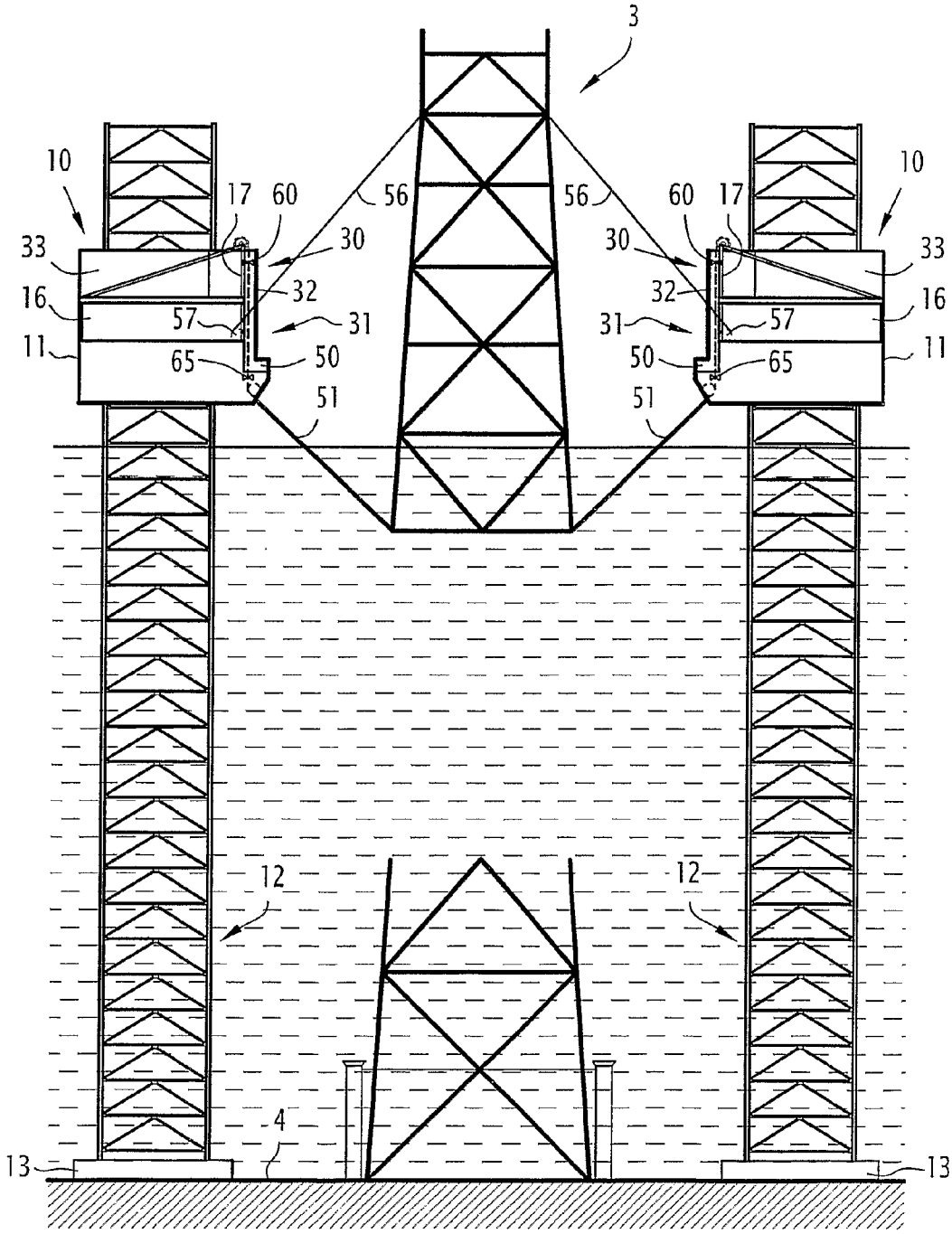

The chains 51 are once again secured on the elements 31 by locking the assemblies 60 and these chains 51 are released from the hull 11 by opening the assemblies 65. The elements 31 of the shuttle 30 are raised so as to also lift the section of supporting column 3 and these operations are repeated to progressively lift this section, as shown in FIG. 9E. Next, the elements 31 of the shuttle 30 supporting the section of supporting column 3 are brought substantially to the level of the hull 11 (FIG. 9F) and the assembly formed by the shuttle 30 and the hull 11 is lowered to float this hull 11, as shown in FIG. 9G.

Figure 9G:
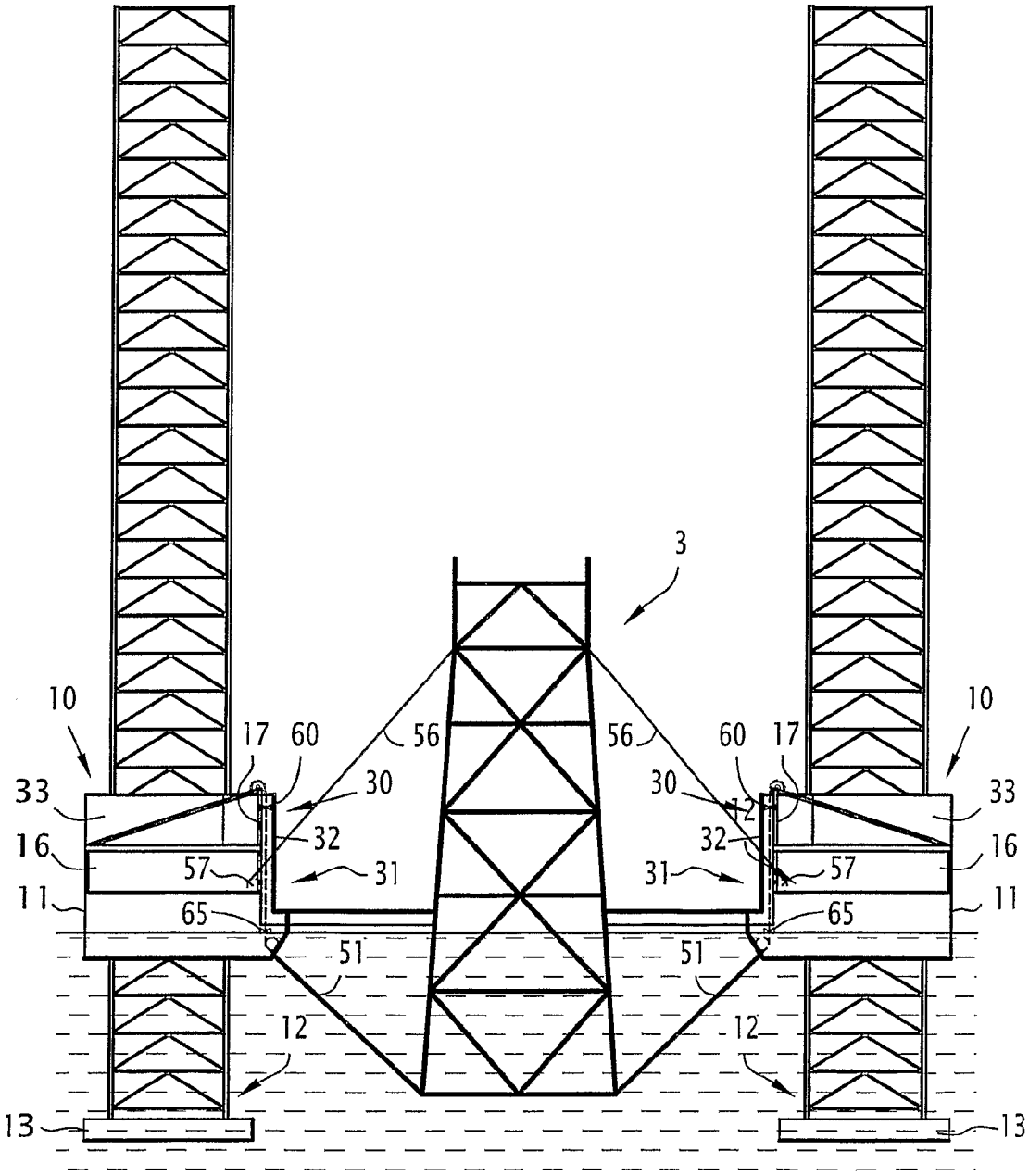

The legs 12 are raised and the structure 10 carrying the supporting column 3 is withdrawn from the production site by floatation (FIG. 9G).

The structure 10 carrying the section of supporting column 3 is floated up to a site for loading this section onto a barge 80.

Figure 9H:
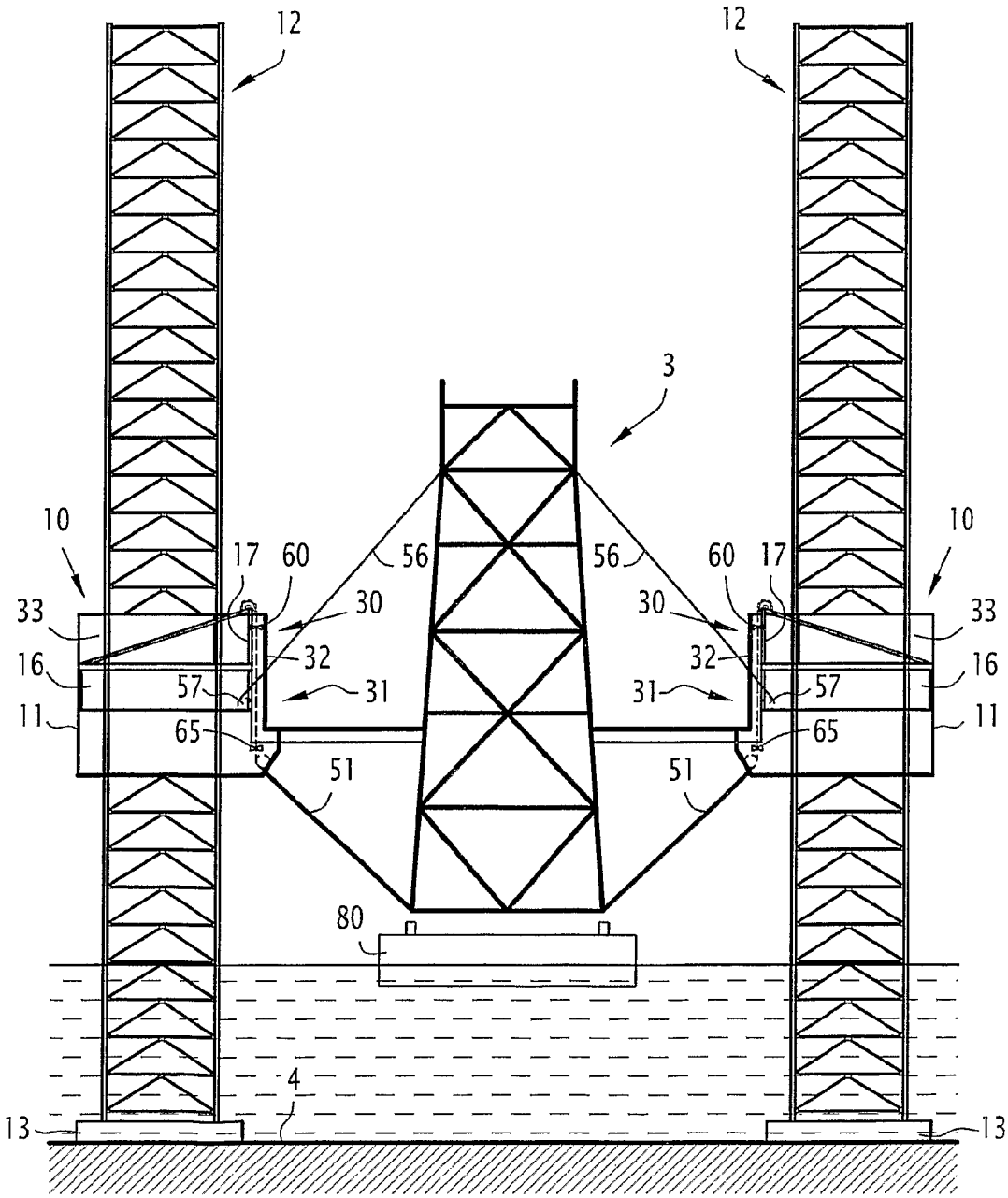
Figure 91:
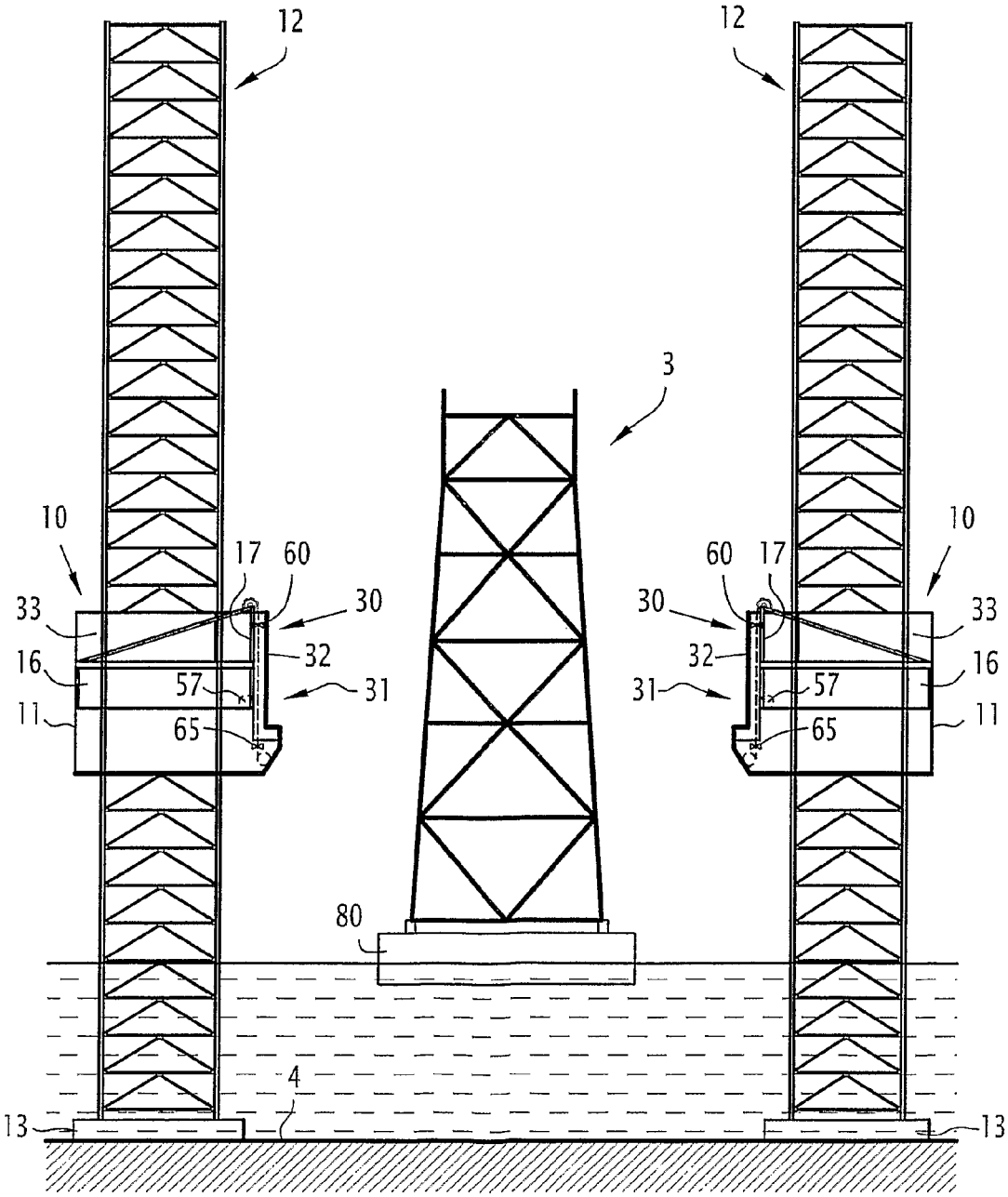
Figure 9J:
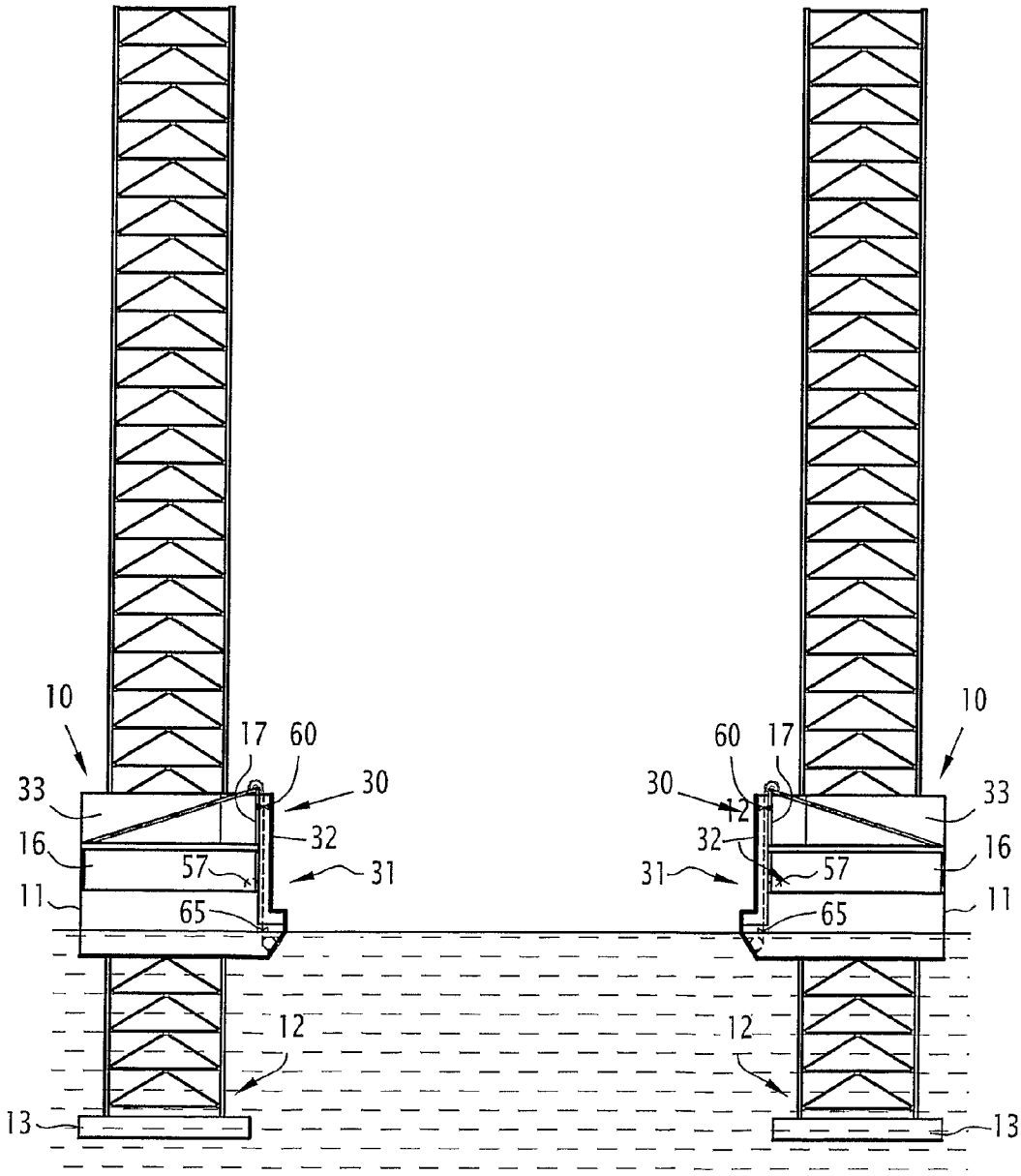
Figure 9K:
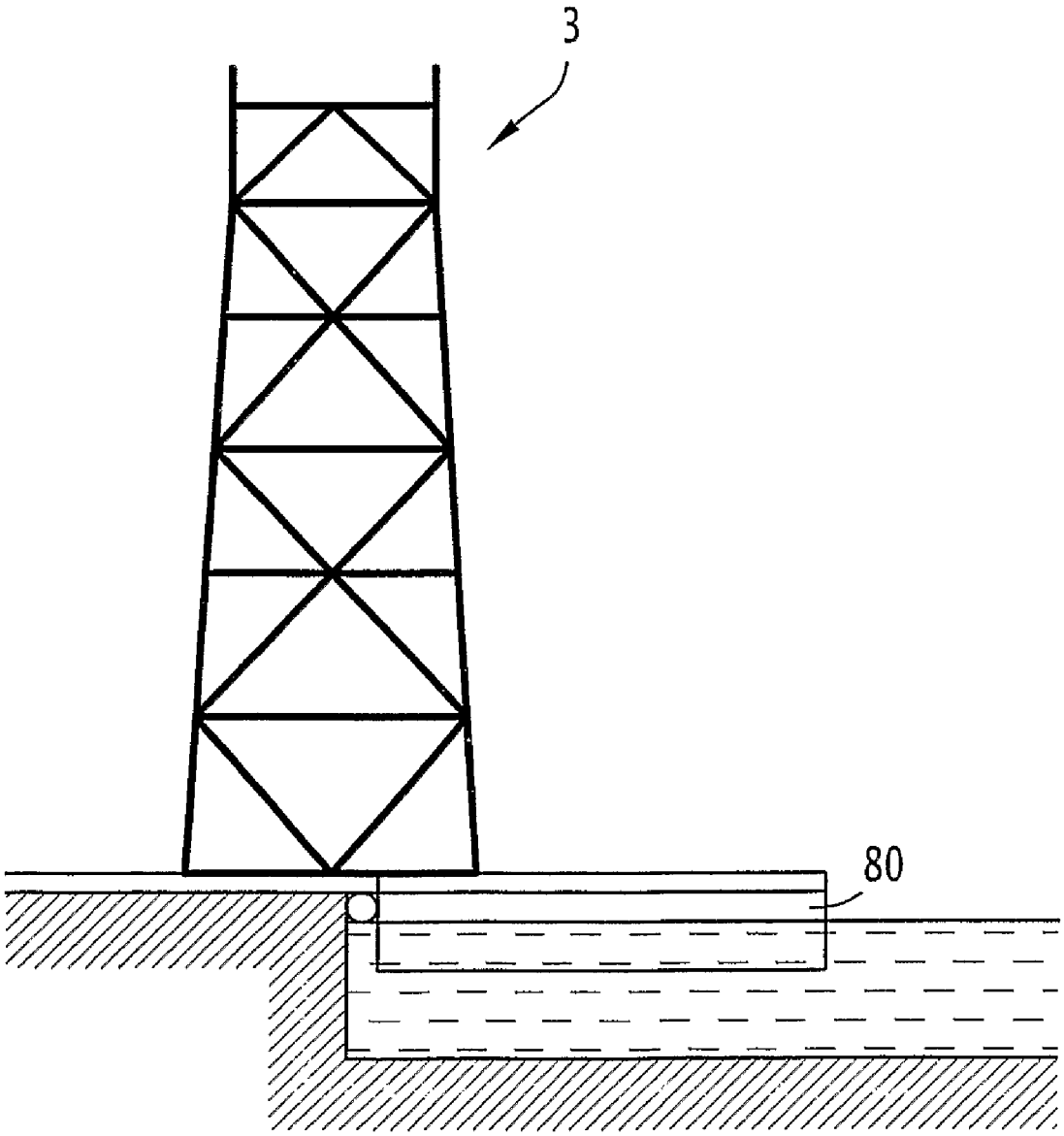

For this, the lifting legs 12 are applied onto the seabed 4 by rotationally driving the pinions 27 and 43 by the geared motor units 26 and 42 and when the lifting legs 12 are in contact with the seabed 4, the hull 11 and the elements 31 of the shuttle 30 are lifted so as to bring the bottom end of the section of supporting column 3 above the water level as shown in FIG. 9H. The barge 80 is brought beneath this section and said section is placed on the barge 80, then the chains 51 together with the cables 56 are disconnected from the section of supporting column 3 (FIG. 9I). The hull 11 is then floated (FIG. 9J) and the legs 12 are raised to enable the structure 10 to be used for another transfer operation of the remaining part of the supporting column 3. The barge 80 carrying the section of supporting column 3 is brought up to a disassembly quay and this section is transferred onto this quay, as shown in FIG. 9K.

The structure 10 can also be used to remove the bottom part of the supporting column 3 or, if this is possible to remove the whole supporting column 3 in a single operation.

Finally, this structure 10 can also be used for installing a supporting column 3 of an oil platform on a production site by substantially performing the same operations in reverse.

In general, the order of some stages of decommissioning of the deck or of the supporting column may be reversed according to the decommissioning conditions.

The structure according to the invention offers the advantage of being able to transport both the deck and the supporting column of an oil platform directly from the production site onto a fixed site where the disassembly can be carried out in complete safety, without risk of polluting the marine environment or vice versa between a fixed site and a production site.

In addition, the various transfer and transport stages are performed without any ballasting operation, thus achieving a considerable saving in time, which is significant in regions where atmospheric conditions change very quickly.

The invention claimed is:

1. A structure for decommissioning and transporting an offshore fixed oil production platform formed by a deck and at least one supporting column, said structure comprising:

a U-shaped floating hull positioned around the offshore fixed oil production platform and fitted with lifting legs configured to rest on the seabed, each lifting leg supporting a mechanical displacement apparatus housed in a bearing framework of said hull;

a shuttle configured to be moved and positioned along the lifting legs and configured to move one of the deck and the at least one supporting column of the production platform, said shuttle comprising elements, each element provided for a respective lifting leg of the lifting legs; and each element comprising a mechanical drive positioned on the respective lifting leg and configured to drive the respective element independently of remaining elements of the shuttle on the other legs, and each element further comprising a respective connecting apparatus including a traction device configured to connect with the deck or the at least one supporting column of the offshore fixed oil production platform, wherein each respective element of the shuttle on each leg is separated from and free of direct physical contact with any other of the elements of the shuttle on another leg, wherein the connecting apparatus comprises for each element of the shuttle a first locking assembly supported by the element and a second locking assembly supported by the hull, the first and second locking assemblies configured to lock and release the traction device successively so as to cause vertical displacement of the supporting column.

2. The structure as claimed in claim 1, wherein the hull includes a bearing framework for each leg and each element of the shuttle includes a vertical guidance branch on the corresponding bearing framework of the hull, and a top section comprising a horizontal branch supporting the mechanical drive of said element on the corresponding leg.

3. The structure as claimed in claim 1, wherein each lifting leg comprises a chord, and the mechanical drive of each element comprises two opposing plates supported by each chord of the corresponding lifting leg;

each plate of the two opposing plates having a lateral face and including a series of teeth on the lateral face, and each element comprising a horizontal branch and at least two opposing assemblies supported by the horizontal branch of said element, and each assembly comprising a pinion driven rotationally and cooperating with one of the series of teeth.

4. The structure as claimed in claim 1, wherein each element comprises a vertical branch including a bottom part, and wherein the connecting apparatus comprises at least a horizontal plate supporting the deck and positioned on the bottom part of the vertical branch of each element.

5. The structure as claimed in claim 1, wherein the connecting apparatus connects to the at least one supporting column of the platform and the traction device is a linear vertical traction device comprising a chain or cable.

6. The structure as claimed in claim 1, wherein each locking assembly comprises two opposing locks configured to tilt vertically toward one another between a position releasing the traction device and a position blocking the traction device.

7. The structure as claimed in claim 1, further comprising an independent branch operable to seal a hull opening and configured to be locked on said hull.

8. The structure of claim 1, wherein the lifting legs comprise at least three lifting legs, and the elements of the shuttle comprise at least three elements, each element of the at least three elements provided for a respective lifting leg of the at least three lifting legs.

9. The structure as claimed in claim 1, wherein each element of the shuttle on each leg is configured to be positioned along the respective leg independently of a position of any other element.

10. The structure as claimed in claim 1, wherein each element of the shuttle on each leg comprises a supporting surface configured to be applied against a bottom surface of the deck so as to support the deck.

11. A method of decommissioning and transporting a framework element of a fixed oil platform formed of a deck between a production site and a quay for disassembling the deck, the method comprising:

positioning beneath the deck a transport structure comprising a U-shaped floating hull fitted with at least three lifting legs configured to rest on the seabed, and a shuttle including at least three elements, each element of the at least three elements provided for one of the at least three lifting legs and positionable independently of remaining elements of the at least three elements along a respective leg of at least three legs;

applying the at least three lifting legs onto a seabed;

lifting the hull and the shuttle to bring said shuttle into contact with the deck;

locking the shuttle onto the lifting legs;

lowering the hull to float the hull;

separating the deck from supporting column;

raising the deck via the intermediary of the shuttle under the rising action of the lifting legs;

displacing the structure supporting the deck to release the deck from the supporting column;

lowering the shuttle supporting the deck to bring the shuttle onto the hull;

floating the structure supporting the deck to the disassembly quay or to a site for unloading onto a barge;

applying the lifting legs onto the seabed to stabilize the hull;

releasing the deck from the structure; and unloading the deck onto the quay or the barge, wherein each element of the shuttle on each leg is separated from and free of direct physical contact with any other element of the shuttle on another leg, and a connecting apparatus configured to connect the element with the framework element, wherein the connecting apparatus comprises for each element of the shuttle two locking assemblies, one locking assembly of the locking assemblies being supported by the element and the other locking assembly of the locking assemblies being, supported by the hull for a gradual vertical displacement of the supporting column by successive locking and releasing of the locking assemblies.

12. The method of claim 11, wherein each lifting leg supports a mechanical displacement apparatus housed in a bearing framework of said hull, and the shuttle is positionable along the lifting legs and operable to move one of the framework elements of the production platform, said shuttle comprising at least three elements, and each element comprises:

a mechanical drive positioned on the associated lifting leg and operable to drive the respective element independently of remaining elements of the at least three elements.

13. A method of decommissioning and transporting a framework element of a fixed oil platform formed of a section of a supporting column between a production site and a quay for disassembling the supporting column the method comprising:

positioning around the supporting column, a U-shaped floating hull fitted with at least three lifting legs for the hull, and a shuttle comprising at least three elements positionable along one of said legs independently of the hull;

applying the lifting legs onto a seabed;

lifting the hull and the elements of the shuttle;

connecting each element of the shuttle to the section of supporting column via a linear traction device;

separating the section of supporting column from the rest of said column;

locking each traction device to each element of the shuttle;

raising the elements of the shuttle to lift the section of supporting column;

locking the traction devices alternately to the elements of the shuttle and the hull and lowering and raising said elements to gradually lift the section of supporting column;

bringing the shuttle supporting the section of supporting column into contact with the hull;

lowering the shuttle and the hull to float the hull;

continuing the descent of the hull to cause the lifting legs of the structure to ascend by reaction;

displacing the structure supporting the section of supporting column to remove the section from the production site and bring it to a loading site on a barge;

applying the lifting legs on the unloading site on the seabed;

lifting the hull and the shuttle to raise the section of supporting column above the water level;

positioning the barge in the structure beneath said section;

lowering the hull and the shuttle to place the section of supporting column onto the barge;

detaching the traction devices from the section of supporting column; and bringing the barge carrying the section of supporting column to the disassembly quay and repeating these stages for other sections of said supporting column.

14. The method of claim 13, wherein the hull is a U-shaped floating hull fitted with at least three lifting legs configured to rest on the seabed, each lifting leg supporting a mechanical displacement apparatus housed in a bearing framework of said hull, the shuttle is positionable along the lifting legs and operable to move one of the framework elements of the production platform, said shuttle comprising at least three elements, each element of the at least three elements provided for a lifting leg of the at least three lifting legs, and each element comprises a mechanical drive positioned on the associated lifting leg, and operable to drive the respective element independently of remaining elements of the at least three elements, and a connecting apparatus configured to connect with the framework element.

15. A structure for decommissioning and transporting an offshore fixed oil production platform formed by a deck and at least one supporting column, said structure comprising:

a U-shaped floating hull fitted with lifting legs configured to rest on the seabed, each lifting leg supporting a mechanical displacement apparatus housed in a bearing framework of said hull;

a shuttle positionable along the lifting legs and configured to move one of the framework elements of the production platform, said shuttle comprising elements, each element provided for a respective lifting leg of the lifting legs, and each element comprising:

a mechanical drive positioned on the associated lifting leg and configured to drive the respective element independently of remaining elements of the shuttle on the other legs; and a connecting apparatus configured to connect with the deck or the at least one supporting column of the oil production platform, wherein the connecting apparatus connects to the at least one supporting column of the platform and comprises for each element of the shuttle a linear vertical traction device comprising a chain or cable and two locking assemblies, one of said assemblies being supported by said element and the other of said assemblies being supported by the hull for a gradual vertical displacement of the supporting column by successive locking of said locking assemblies.

16. The structure as claimed in claim 15, wherein each locking assembly comprises two opposing locks configured to tilt vertically toward one another between a position releasing the traction device and a position blocking the traction device.

* * * * *